US008429929B2

(12) United States Patent
Aragon

(10) Patent No.: US 8,429,929 B2
(45) Date of Patent: Apr. 30, 2013

(54) FLEXIBLE DOOR PANEL COLD STORAGE DOOR SYSTEM

(75) Inventor: Daniel M. Aragon, Eagle, ID (US)

(73) Assignee: Cold Chain, LLC, Boise, ID (US)

( * ) Notice: Subject to any disclaimer, the term of this patent is extended or adjusted under 35 U.S.C. 154(b) by 899 days.

(21) Appl. No.: 12/546,642

(22) Filed: Aug. 24, 2009

(65) Prior Publication Data

US 2011/0041411 A1 Feb. 24, 2011

(51) Int. Cl.
*F25D 21/00* (2006.01)
*E06B 3/36* (2006.01)

(52) U.S. Cl.
USPC ..... 62/449; 49/478.1; 49/409; 49/410; 49/411; 49/116; 52/204.1; 454/195

(58) Field of Classification Search ..... 49/478.1, 49/409–411, 116, 118, 120, 370; 62/449; 52/204.1; 454/195
See application file for complete search history.

(56) References Cited

U.S. PATENT DOCUMENTS

| | | | | |
|---|---|---|---|---|
| 2,731,804 | A * | 1/1956 | Grubbs, Sr. | 62/156 |
| 3,137,900 | A * | 6/1964 | Carbary | 49/478.1 |
| 3,362,108 | A * | 1/1968 | Jones | 49/478.1 |
| 4,084,347 | A * | 4/1978 | Brown | 49/397 |
| 4,127,765 | A | 11/1978 | Heaney | |
| 4,950,869 | A * | 8/1990 | Mueller | 219/218 |
| 5,329,781 | A * | 7/1994 | Farrey et al. | 62/82 |
| 6,225,904 | B1 * | 5/2001 | Jaffe et al. | 340/545.6 |
| 6,226,995 | B1 * | 5/2001 | Kalempa et al. | 62/80 |
| 6,360,487 | B1 * | 3/2002 | Kern et al. | 49/231 |
| 6,983,565 | B2 * | 1/2006 | Berry et al. | 49/370 |
| 7,367,159 | B2 * | 5/2008 | Delgado et al. | 49/120 |
| 7,984,794 | B2 * | 7/2011 | Kuipers et al. | 187/334 |
| 2002/0056236 | A1 * | 5/2002 | Kalempa et al. | 49/478.1 |
| 2004/0231244 | A2 * | 11/2004 | Kalempa et al. | 49/478.1 |
| 2006/0090401 | A1 | 5/2006 | Berry et al. | |
| 2008/0250716 | A1 * | 10/2008 | Ranaudo et al. | 49/31 |
| 2011/0011003 | A1 * | 1/2011 | Vogel et al. | 49/399 |

OTHER PUBLICATIONS

International Searching Authority, "International Search Report and Written Opinion from PCT/US2010/045919 dated Oct. 7, 2010".

* cited by examiner

*Primary Examiner* — Steven B McAllister
*Assistant Examiner* — Nathaniel Herzfeld
(74) *Attorney, Agent, or Firm* — MH2 Technology Law Group, LLP

(57) ABSTRACT

A flexible door panel cold storage door system incorporates a flexible movable door panel having an internal support frame assembly and the door panel has a plurality of gasket sections removably attached to a cold space surface of a door panel jacket with each gasket section having at least one ferrous gasket target and the gasket sections are aligned and cooperate with a plurality of electromagnets that are mounted in a doorframe assembly when the door panel is in a closed position. The electromagnets are mounted in wells in the doorframe assembly and are powered on when the door panel is in the closed position and the wells are interconnected by a ventilation channel that conducts air heated by operation of the electromagnets through the ventilation channel and into and through a bottom sweep assembly of the door panel in a closed loop. The heated air reduces or eliminates problems of icing in the immediate vicinity of the periphery of the door panel and reduces or eliminates problems of freezing of the door panel in a closed position. The gasket sections are easily replaced if worn or damaged during use.

23 Claims, 23 Drawing Sheets

FLEXIBLE DOOR PANEL COLD STORAGE DOOR SYSTEM

CROSS-REFERENCE TO RELATED APPLICATIONS

Not Applicable

STATEMENT REGARDING FEDERALLY SPONSORED RESEARCH OR DEVELOPMENT

Not Applicable

REFERENCE TO A MICROFICHE APPENDIX

Not Applicable

BACKGROUND OF THE INVENTION

In modern society, cold storage facilities often have forklift accessible door openings into a cold space from a warm space. Various barrier devices including overhead suspended sliding insulated doors have been used in the past to provide some measure of thermal control and to secure the door openings from unwanted intrusions.

With many prior art doors, there have been problems of unwanted heat exchange between the cold and warm spaces, ice buildups in and around the door opening, and unwanted freezing of the closed door in the door opening. Additionally, many prior art doors are more susceptible to unwanted impact damage from forklifts, forklift loads, or other moving objects that may impact the door during operations in or about the door opening by such equipment and objects.

Forklift operations through and near door openings and associated sliding doors in cold storage facilities often result in impact incidents between the forklift or forklift loads and the doors that selectively close the door opening resulting in unwanted damage to the door that often necessitates expensive repair or replacement of the door or associated structures.

The present invention relates to a novel flexible door panel cold storage door system having at least one overhead track-mounted horizontally sliding flexible door panel useful for the convenient closing and opening of a door opening into a cold storage area that incorporates features that reduce or eliminate the above mentioned problems.

The instant invention incorporates a novel movable door panel that reduces or eliminates damage to the door panel that might result from impact incidents and reduces maintenance and downtime as compared with many other prior art cold storage sliding doors that would suffer significant damage and require significant maintenance and undesirable downtime from comparable impact incidents. The instant invention is designed for easy and convenient repair in the event of any damage from impact incidents involving the door panel.

The instant invention incorporates a movable flexible door panel having spaced vertical suspension cables, at least two vertical stiffeners, and at least one horizontal stiffener closely and elastically attached between and to the vertical stiffeners and provides a durable panel that has improved resistance to undesired breaching or damage of the panel by accident or by malicious intent by unauthorized entities or forces.

The door hanger assemblies of the instant invention allow the door panel to swing outward away or inward toward the wall during an impact incident and lessen the likelihood of damage to the hanger assemblies and to the overhead horizontal track and carriage system to which the hanger assemblies are attached

BRIEF SUMMARY OF THE INVENTION

The present invention relates to a novel flexible door panel cold storage door system 10 for selectively blocking and unblocking a door opening 8, having a surrounding doorframe assembly 12, in a boundary wall 6 between a cold space 2 and a warm space 4 in a cold storage facility with a movable flexible door panel 66.

The novel flexible door panel cold storage door system uses heat generated by the operation of a plurality of electromagnets 36 to reduce or eliminate frost and ice in and around the door opening 8, the doorframe assembly 12, and the door panel 66.

In the best embodiment, the electromagnets 36 promote an improved sealing between the door panel 66 and a doorframe assembly 12; the electromagnets generate heat that is dispersed into a heat dispersion layer 34, a nonferrous doorframe outer jacket 46, and a plurality of gasket sections 148 and 164 attached to a door panel jacket 104 to preclude icing and freezing of a sealing zone between the door panel and the doorframe assembly. The electromagnets preferably are powered when the door panel is in a selected stationary closed position and generate heat that warms air that is circulated through a frame core ventilation channel 32 in the doorframe assembly in close proximity to an interface between the doorframe assembly and the movable door panel.

In the best embodiment, the electromagnets are powered to attract ferrous gasket targets 154 when the door panel is in a closed position and air warmed by the operation of the electromagnets is circulated by at least one inline ventilation fan 40 in a substantially closed loop through the ventilation channel 32 that interconnects a plurality of electromagnet wells 26, 28, 30 in which the electromagnets are mounted and through at least one interconnected bottom sweep assembly air channel 144 when the door panel is in a closed position. Additionally, in the best embodiment a heat dispersion layer 34 that is in close contact with portions of the electromagnets disperses heat from the operating electromagnets to help warm the overlaying doorframe outer jacket 46.

The best embodiment of the instant invention provides a seal between the door panel 66 and the doorframe assembly 12 and a close contact sliding seal between a bottom sweep assembly 124, 324, 424 of the door panel and a floor surface within the door opening 8.

In the best embodiment of the invention, the bottom sweep assembly air channel 144, 344, 444 circulates warmed air that reduces or eliminates ice build-up beneath the door panel and lessens or eliminates the likelihood that the door panel in the closed position will freeze to the floor surface beneath the door panel structure.

Additional and various other objects and advantages attained by the invention will become more apparent as the specification is read and the accompanying figures are reviewed.

DETAILED DESCRIPTION OF THE INVENTION

Figure 1:
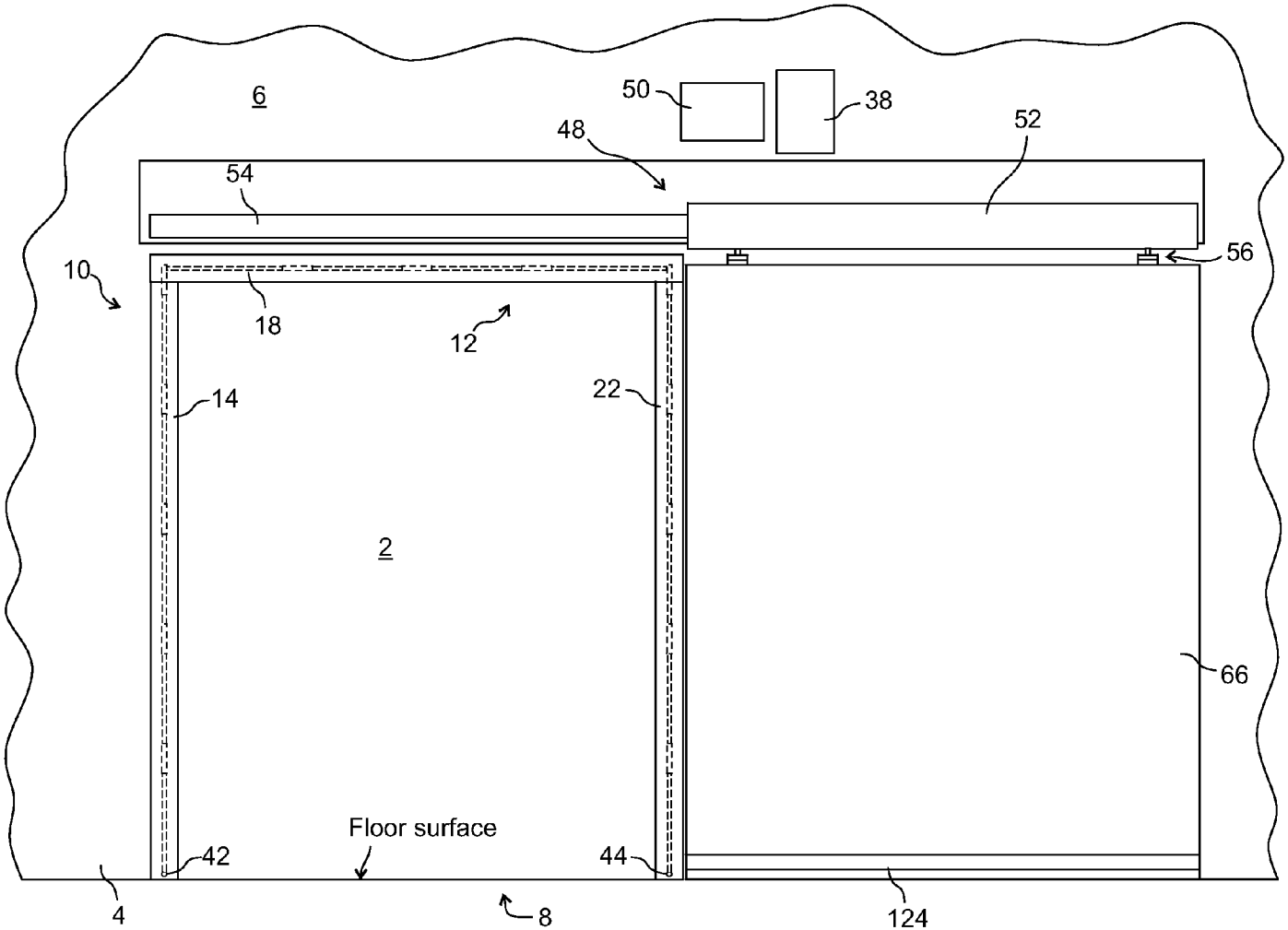
FIG. 1 is a front-side view of a flexible door panel cold storage door system 10 of the preferred embodiment showing a flexible door panel 66 in an open position with stay roller assemblies not shown.
Figure 2A:
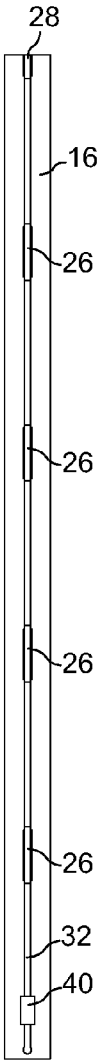
FIG. 2A is a front-side plan view of a vertical left frame core 16 showing a plurality of electromagnet wells 26 and a half-length electromagnetic well 28, and a frame core ventilation channel 32 communicating into, through, and between each well and communicating to, through, and extending beyond an inline ventilation fan 40 (shown schematically)
Figure 2B:
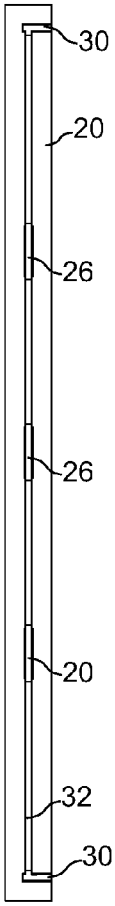
FIG. 2B is a front-side plan view of a horizontal top frame core 20 showing a plurality of electromagnet wells 26 between two half-length electromagnet wells 30 and a frame core ventilation channel 32 communicating into, through, and between each well.
Figure 2C:
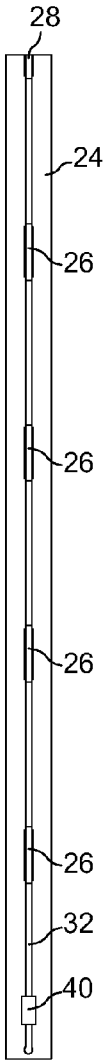
FIG. 2C is a front-side plan view of a vertical right frame core 24 showing a plurality of electromagnet wells 26 and a half-length electromagnetic well 28, and a frame core ventilation channel 32 communicating into, through, and between each well and communicating to, through, and extending beyond an inline ventilation fan 40 (shown schematically)
Figure 3A:
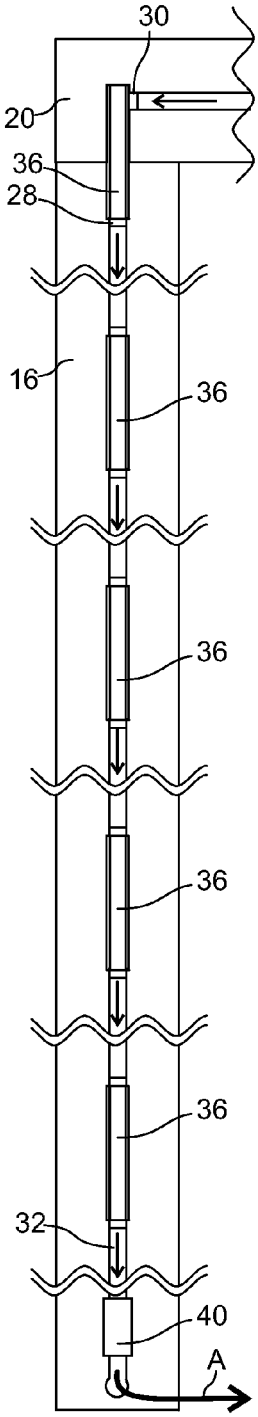
FIG. 3A is a partial front-side plan view of the vertical left frame core 16 shown in FIG. 2A mounted adjacent and perpendicularly to a left end of the top horizontal frame core 20 shown in FIG. 2B with cooperating and adjacent half-length electromagnet wells 28 and 30 aligned to receive and hold an electromagnet 36 and showing a plurality of electromagnets mounted with one in each of the plurality of electromagnet wells, unlabeled arrows and arrow A depict air flow leftward and downward through the frame core ventilation channel 32 and out of the ventilation channel downstream of the inline ventilation fan 40.
Figure 3B:
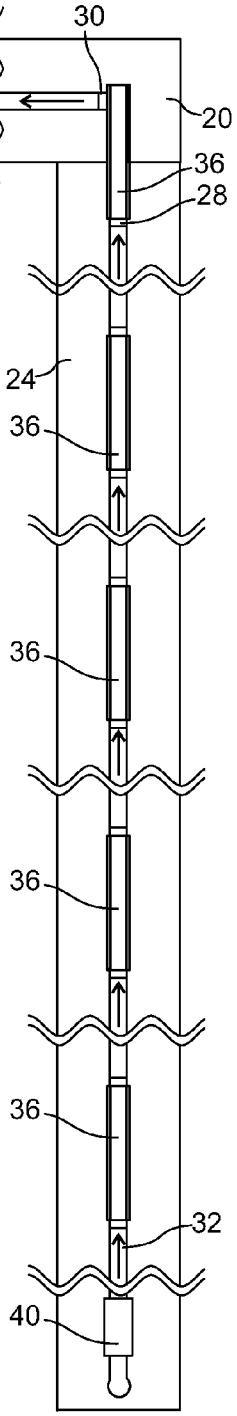
FIG. 3B is a partial front-side plan view of the vertical right frame core 24 shown in FIG. 2C mounted adjacent and perpendicularly to a right end of the top horizontal frame core 20 shown in FIG. 2B with cooperating and adjacent half-length electromagnet wells 28 and 30 aligned to receive and hold an electromagnet 36 and showing a plurality of electromagnets mounted with one in each of the plurality of electromagnet wells, unlabeled arrows depict airflow upward and leftward through the frame core ventilation channel 32.

Referring to FIGS. 1 through 35, a flexible door panel cold storage door system 10 for selectively blocking and unblocking a door opening 8 in a boundary wall 6 between a cold space 2 and a warm space 4 includes a doorframe assembly 12, having a vertical left frame 14, a horizontal top frame 18, and a vertical right frame 22 mounted to or in said wall to contiguously define together with a floor surface between the left frame and the right frame the door opening.

The left frame 14 has a left frame core 16; the top frame 18 has a top frame core 20; and the right frame 22 has a right frame core 24; each frame core has a frame core top surface and a longitudinal top surface centerline; the frame cores are preferably made of wood or a suitable composite material.

A plurality of open electromagnet wells 26 are formed in the frame cores and distributed along and proximate to the centerlines; a frame core ventilation channel 32 is formed or routed in the frame core top surfaces.

The ventilation channel 32 has a first end near said left frame core's bottom end and the ventilation channel contiguously and serially communicating to and through each well in each frame core and the ventilation channel having a second end near the right frame core's bottom end.

A plurality of electromagnets 36 are operably mounted one electromagnet in each well and mounted substantially flush to the adjacent frame core top surface that surrounds that respective well. The electromagnets 36 are selectively energized by a D/C power supply 38 that is electrically connected to said electromagnets; the power supply is selectively controlled by an electric door operator control box 50.

When the door is in the closed position, the electromagnets 36 are powered on to generate a plurality of magnetic fields to attract a plurality of ferrous gasket targets 154 toward respective electromagnets and to generate heat to warm air circulating in close proximity to the electromagnets.

A signal to open and a signal to close the door can be initiated by a manually operated switch connected to the control box or by a radar system, an induction loop system, a radio transmitters/receiver system, a photocell system, a pull-cord switch system, or some other suitable signaling device known in the art that can communicate with the control box.

Preferably, each installation of the instant invention includes a D/C power supply 38 that is a 12 volt system that is custom fabricated to supply the required wattage needed to power the number of electromagnets used in the specific door system being installed; the power will vary depending upon the door size and the number and size of the electromagnets used.

Preferably, the D/C power supply 38 is controlled via a 120 volt power switch located inside of the door operator control box 50. The power switch is selectively activated in response to a door operator control switch that is selectively activated via a manufacturer's supplied pull cord, a push button, a magnetic floor loop/forklift detection, a radio remote, or another suitable activation system. The power switch is configured to switch the power of the 12 volt power supply to the electromagnets ON when the door panel is in a closed position and OFF when the door is signaled to be opened, while the door panel is in motion, and while the door panel is in an open position.

Preferably, the power supply 38 sends a brief (fraction of a second) reverse current to the pole plates of the electromagnets when the electromagnets are powered off to scramble the magnetic fields and help ensure that the ferrous gasket targets 154 release from the electromagnets during opening of the door opening by the moving door panel.

Preferably, after a signal to close the door panel from an open position to a closed position, the power switch is configured with about a 5 second delay regarding the powering of the electromagnets to ON to allow the door panel to fully close before powering on the electromagnets.

In a fully-assembled preferred embodiment of the invention, a nonferrous doorframe outer jacket 46 is attached, preferably with removable fasteners, to the frame cores 16, 20, and 24 to substantially cover the frame cores, the ventilation channel 32, and the electromagnets 36.

Figure 35:
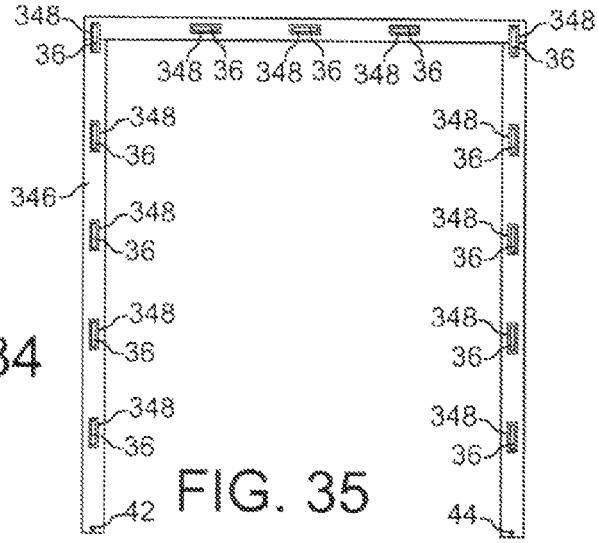
FIG. 35 is a front-side plan view of an alternative nonferrous doorframe outer jacket 346 having a plurality of window openings 348 with each window opening overlaying a respective electromagnet 36.

FIG. 35 shows an alternative nonferrous doorframe outer jacket 346 having a plurality of window openings with each window opening overlaying a respective electromagnet 36.

Preferably, there are two air ventilation ports 42 and 44 through the outer jacket 46 and the ventilation ports communicate with the ventilation channel 32 with one ventilation port located proximate the first end of the ventilation channel and the other ventilation port located proximate the second end of the ventilation channel.

A movable flexible door panel 66 has a door panel jacket 104 and has a door panel periphery and the door panel is selectively disposable against the doorframe outer jacket 46 to at least partially block the door opening 8 when in a closed position, and the door panel substantially unblocking the door opening when in an open position. The door panel jacket 104 has an upper end and a lower end.

Two bottom sweep gasket sections 164 are removably attached by attachment means to the door panel jacket proximate the lower end along the door panel periphery that overlaps two portions of the doorframe outer jacket when the door panel is in the closed position with one bottom sweep gasket section located proximate the first end and the other bottom sweep gasket section located proximate the second end. The attachment means preferably comprises cooperating hook pads and loop pads selectively fixed to the panel jacket and to each gasket section. The hook pads and loop pads could be replaced by cooperating permanent magnet strips fixed one to the panel jacket and one to each gasket section or replaced by use of a suitable adhesive or by stitching with needle and thread.

A plurality of intermediate gasket sections 148 are removably and contiguously attached by attachment means to the door panel jacket between and proximate to two bottom sweep gasket sections 164 and along a contiguous portion of the door panel periphery that overlaps a contiguous portion of the doorframe outer jacket when the door panel is in the closed position and the gasket sections are operably configured to form an air seal with the doorframe outer jacket when the door panel is in the closed position.

Preferably, in each embodiment of the invention, each gasket section has at least one ferrous gasket target 154 located proximate the gasket section's top surface spaced away from the door panel jacket 104 and towards the doorframe outer jacket 46 and each ferrous gasket target is aligned to cooperate and be magnetically attracted by and towards one of the electromagnets when the door panel is in the closed position and the electromagnets are powered on (energized).

In all embodiments of the flexible panel cold storage door system 10 invention, a doorframe assembly 12 has a vertical left frame 14 having a left frame core 16 and a bottom end, a horizontal top frame 18 having a top frame core 20, and a vertical right frame 22 having a right frame core 24 and a bottom end; the frame cores have a plurality of electromagnet wells 26 formed in them to receive and mount a plurality of electromagnets 36, the wells may include cooperating half-length electromagnet wells 28 and 30 that together in respective abutting pairs form a well that may receive and mount an electromagnet; a frame core ventilation channel 32 is formed in the frame core top surfaces and the ventilation channel has a first end near the left frame core's bottom end and the ventilation channel contiguously and serially communicates to and through each well in each frame core and the ventilation channel has a second end near the right frame core's bottom end.

Preferably, a heat dispersion layer 34 preferably made of aluminum foil is interposed between the frame cores and the plurality of electromagnets 36 that are mounted in the wells 26 and cooperating half-length wells 28 and 30 and the dispersion layer proximately lines the wells and the core frame ventilation channel 32 and substantially covers the frame core top surfaces.

A D/C power supply for electromagnets 38, preferably a 12 volt system, selectively powers the electromagnets 36 and one or more inline ventilation fans 40 that are emplaced in the core frame ventilation channel 32 to move air through the ventilation channel.

Preferably, there are two air ventilation ports 42 and 44 in the nonferrous doorframe outer jacket 46 and each ventilation port communicates with the core frame ventilation channel 32 with one port located proximate the first end of the ventilation channel and the other port located proximate the second end of the ventilation channel.

The invention preferably is operatively suspended from a conventional overhead horizontal track and carriage system 48 that is controlled by an electric door operator control box 50. The carriage system 48 includes at least one carriage assembly 52 or 352 and 452 that is or are movably mounted on an overhead horizontal track 54, 254 that is mounted above and across the horizontal top frame 18 and at least two door hanger assemblies 56 attach a flexible door panel 66 to the carriage assembly or attach two leaves 220 and 224 to respective carriage assemblies 352 and 452.

Preferably, each door hanger assembly 56 has a hanger bracket 58 that is attached to a header 68 of the door panel 66 and the bracket rotatably mounts a horizontal hanger member 60 that is preferably secured in the bracket by a retainer 62 such as a C-clip or comparable securing device, the horizontal hanger member has a midpoint transverse bore to receive and retain a transverse vertical hanger member 64 that is preferably a threaded bolt and the vertical hanger member attaches the hanger assembly to a carriage assembly 52 or to one of two alternate carriage assemblies 352 and 452.

In the best embodiment, a flexible door panel 66 has an internal support frame assembly 74 that supports the door panel and suspends the door panel from a carriage assembly 52 or 352 and 452; each support frame assembly 74 has a header 68 spaced from and connected to at least one door panel base plate segment 80 by at least two spaced vertical suspension cables 78, each of the two suspension cables is threaded lengthwise through and retained respectively in one of at least two vertical tube stiffeners 86; at least one horizontal tube stiffener 94 is attached proximately and elastically to and perpendicularly between the two vertical tube stiffeners; a plurality of flexible insulation sheets 72 facing and proximate to one another with at least one insulation sheet on each side of the frame assembly and the insulation sheets supported by the frame assembly; a door panel jacket 104 having an upper end and a lower end encapsulates the support frame assembly and the insulation sheets; and at least two door hanger assemblies 56 are spaced and aligned coaxially and attached proximate the upper end to the header.

Figure 20:
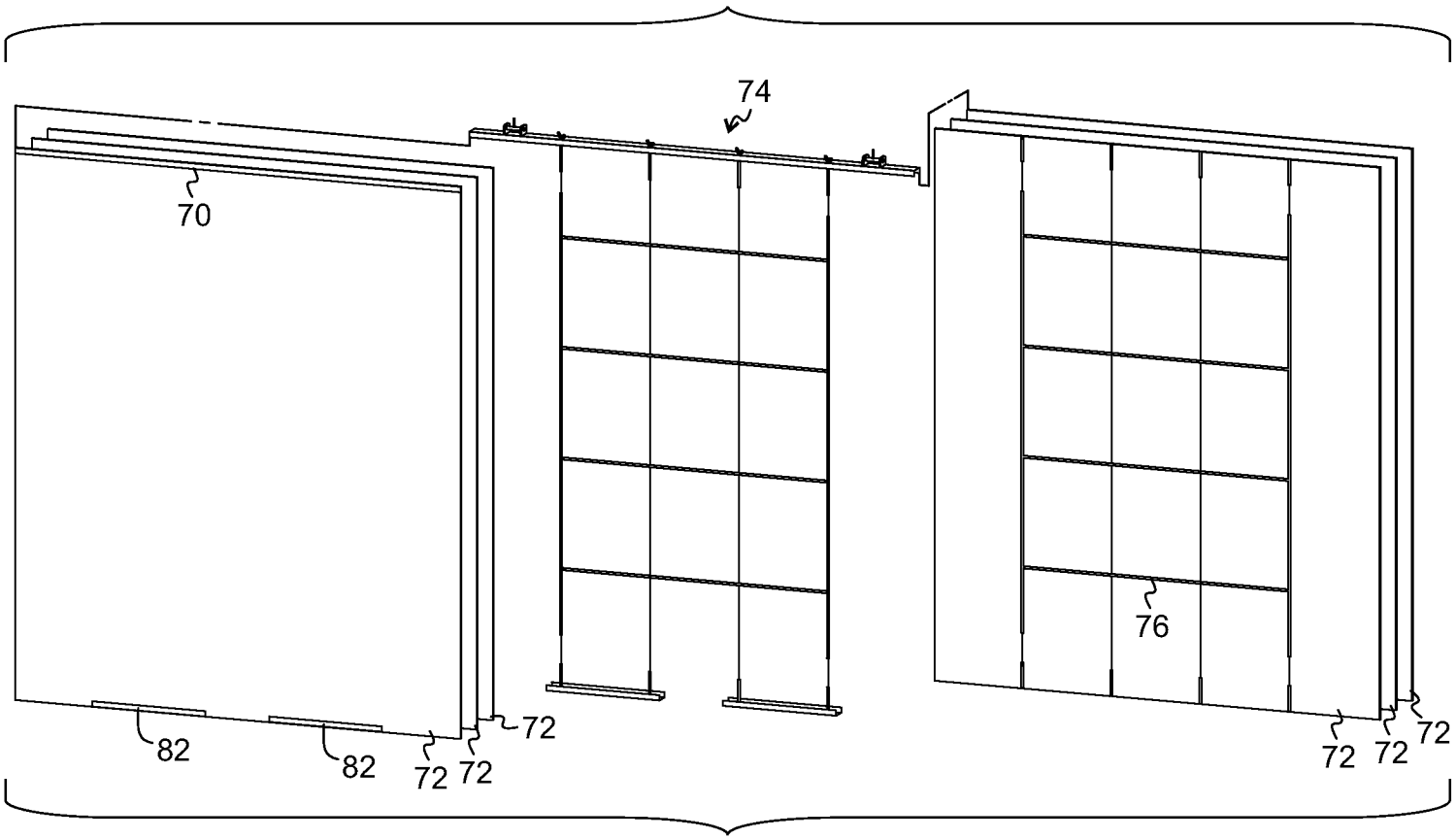
FIG. 20 is a partially exploded perspective view of a flexible door panel with a door panel jacket removed showing a plurality of flexible insulation sheets 72 that encapsulate and sandwich the support frame assembly 74.
Figure 21:
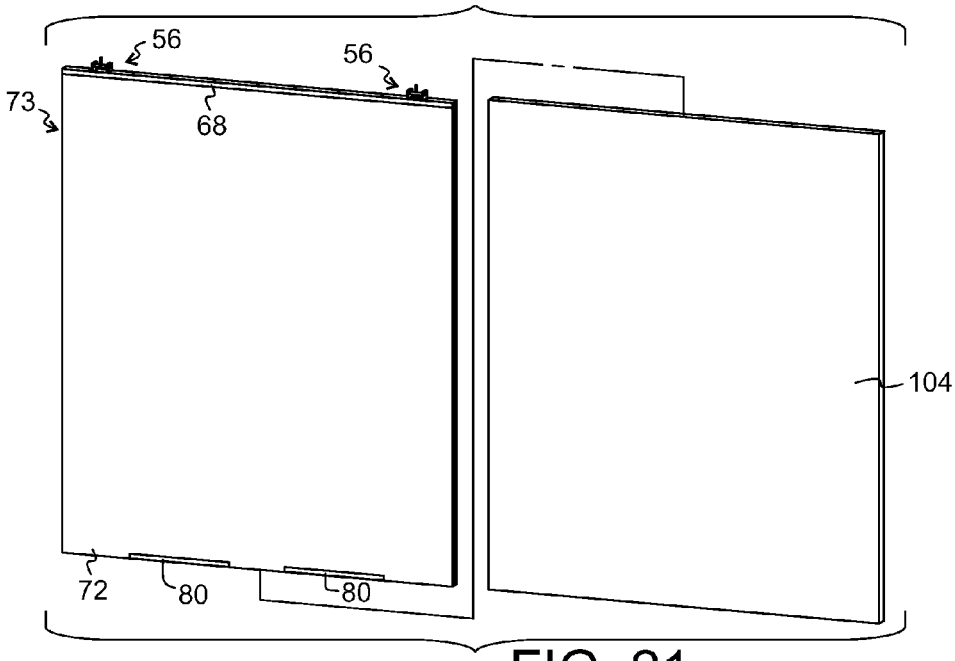
FIG. 21 is a partially exploded perspective view of a door panel showing the encapsulated support frame assembly 73 shown in FIG. 20 along side a door panel jacket 104 that will receive and retain the encapsulated support frame assembly within said jacket.
Figure 22A:
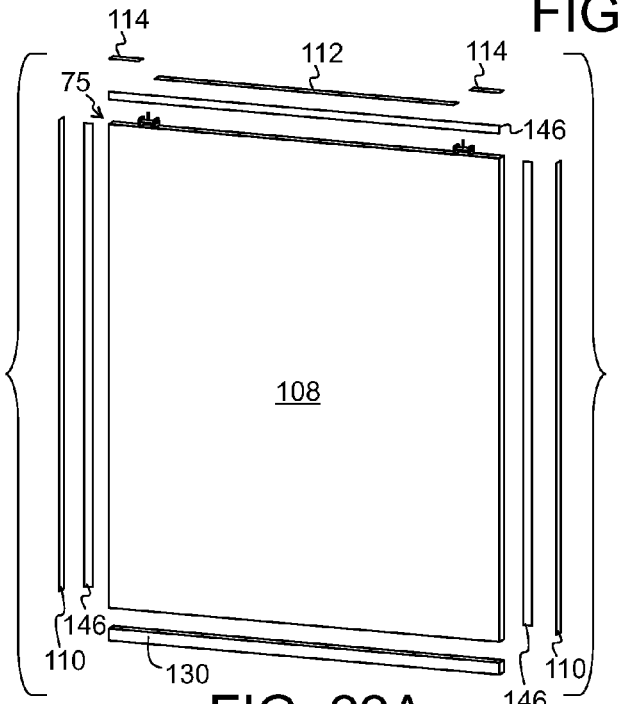
FIG. 22A is a partially exploded perspective view of a jacketed encapsulated support frame assembly 75 shown in FIG. 21 showing a plurality of hook pads 110, 112, 114, 130, 146 to be attached to the jacketed encapsulated support frame assembly.
Figure 22B:
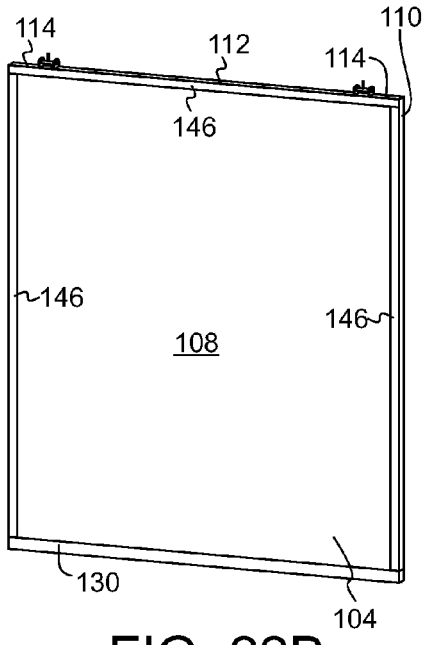
FIG. 22B is a perspective view of the jacketed encapsulated support frame assembly 75 shown in FIG. 21 showing the plurality of hook pads 110, 112, 114, 130, 146 attached to said jacketed encapsulated support frame assembly.
Figure 23A:
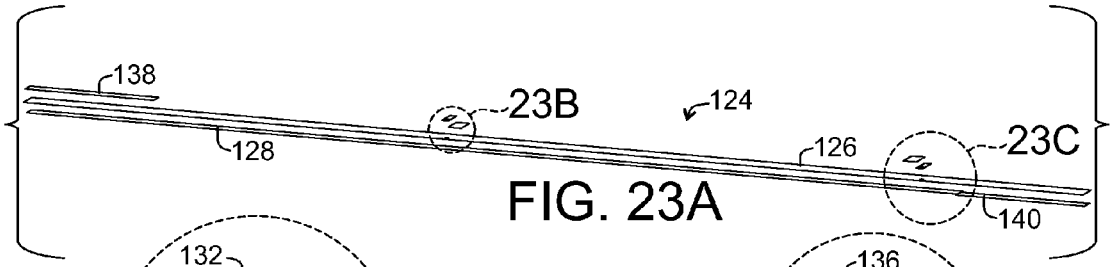
FIG. 23A is an exploded perspective view of a bottom sweep assembly 124.
Figure 23B:
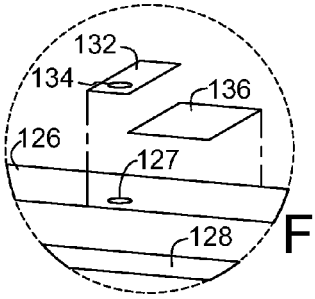
FIG. 23B is an enlarged view of an indicated portion of FIG. 23A.
Figure 23C:
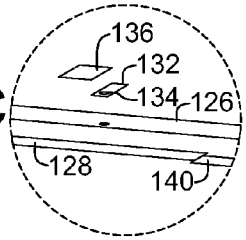
FIG. 23C is an enlarged view of an indicated portion of FIG. 23A.
Figure 23D:
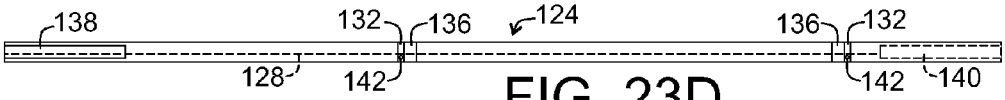
FIG. 23D is a plan view of the bottom sweep assembly 124 shown in FIG. 23A.

Preferably, as shown in FIG. 20, a header relief 70 to receive the header 68 is formed in upper portions of the outermost insulation sheets 72 and a base plate segment relief 82 is formed in lower portions of the outermost insulation sheets to receive base plate segments 80 to provide smoother outside faces to the plurality of flexible insulation sheets; and a support frame assembly relief 76 is provided in a facing surface of at least one of the insulation sheets immediately adjacent the support frame assembly 74 to closely receive the support frame assembly.

Preferably, each vertical suspension cable 78 at each end has a threaded cable end coupler 84 to interact at the top of the support frame assembly 74 with a respective wing nut 90 to attach the cable to the header 68 and at the bottom of the support frame assembly with a respective nut 92 to attach the cable to a bottom plate segment 80 and to allow vertical adjustment of the length of each cable and thereby allowing adjustment of the amount of separation between the header and the bottom plate segments after the door panel is assembled.

Preferably, each vertical tube stiffener 86 has at least one vertical tube stiffener transverse bore 88 aligned with a corresponding bore in at least one other vertical tube stiffener; at least one horizontal tube stiffener 94 is attached proximately and elastically to and perpendicularly between the two vertical tube stiffeners by an elastic cord 100 or a spiral spring threaded through the horizontal tube stiffener and through and anchored beyond each vertical tube stiffener transverse bore by an anchor clip 102 or other suitable retaining device.

Preferably, each horizontal tube stiffener 94 has a horizontal tube stiffener transverse bore 96 associated with each vertical suspension cable 78 that intersects the horizontal tube stiffener for receiving there through the respective cable.

Preferably, each stiffener transverse bore 88 and 96 has a tube grommet 98 preferably made of resilient rubber or other suitable material inserted in each transverse bore to encircle a respective cable, cord, or spiral spring threaded there through.

As shown in FIGS. 7, 11, 14, 22A, and 22B, in the best embodiment of the invention, the door panel jacket 104 has at least one hook pad 110, 112, 114, 130, or 146 attached to each of five of six outer surfaces of the door panel jacket: a panel jacket warm space surface 106 and a panel jacket cold space surface 108 spaced parallel from each other together have a lower end attachment hook strip 130 attached to, about, and encircling the lower end of the door panel; the cold space surface has at least one perimeter hook pad 146 attached along left, top, and right portions of the cold space surface's perimeter; two panel jacket side surfaces each having at least one panel jacket side surface hook pad 110 attached; and a panel jacket top surface has at least one panel jacket top surface hook pad 112 attached. Preferably, two panel jacket top surface end hook pads 114 are attached to the panel jacket top surface at opposite ends of the panel jacket top surface and bracket the panel jacket top surface hook pad 112.

FIG. 23A to 25 show the best embodiment of a bottom sweep assembly 124 having a flexible two-layer bottom sweep base strip 126 having two base strip apertures 127; a bottom sweep attachment loop strip 128 attached along an upper length of an inner side of the base strip, the bottom sweep attachment loop strip removably attaches the bottom sweep assembly to the lower end attachment hook strip 130; at least one, but preferably two, bottom sweep gasket section hook pads 132, each having a bottom sweep gasket section hook pad aperture 134 are spaced and attached on an outer side of the base strip and each hook pad aperture communicates respectively and defines with one of the base strip apertures one of two bottom sweep assembly air ports 142, and when the sweep assembly is attached to the door jacket, each sweep gasket section hook pad respectively is aligned to engage a bottom sweep gasket section loop pad 176 of a bottom sweep gasket section 164.

Preferably, adjacent each sweep gasket section hook pad 132 is attached a bottom sweep side skirt hook pad 136 that aligns with a respective panel jacket side surface when the bottom sweep assembly 124 is attached around and extended downward beyond the lower end of the panel jacket and the sweep assembly air ports 142 communicate with a bottom sweep assembly air channel 144 preferably defined by a bottom surface of the jacket, an inner surface of the base strip 126 below the bottom sweep attachment loop strip 128, and the underlying floor surface.

Preferably, the base strip 126 is secured as a closed loop strip to, about, and encircling the lower end of the jacket by a bottom sweep closure loop pad 138 attached to one end of the base strip removably engaging a bottom sweep closure hook pad 140 attached to the other end of the base strip.

Figure 24:
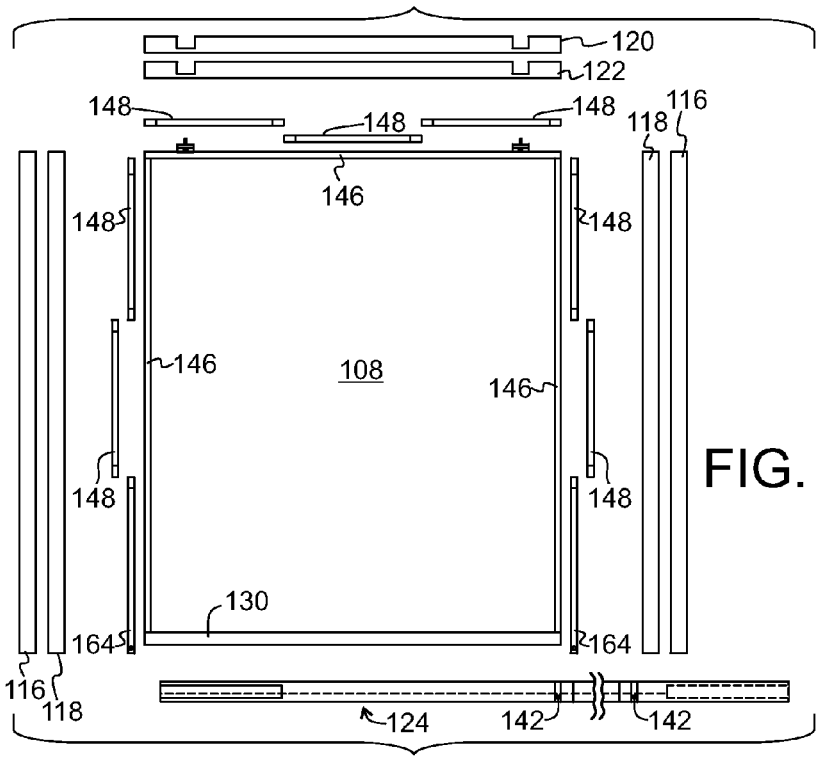
FIG. 24 is a partially exploded rear-side plan view of a flexible door panel 66.
Figure 25:
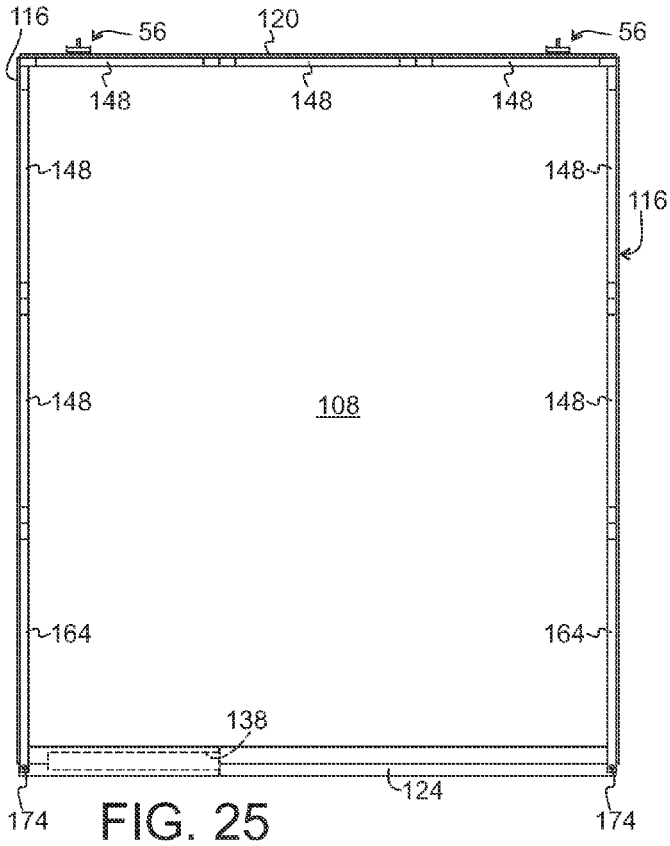
FIG. 25 is a rear-side plan view of the flexible door panel 66 shown in FIG. 24 showing two side skirt assemblies 116, a top skirt assembly 120, a bottom sweep assembly 124, seven intermediate gasket sections 148, and two bottom sweep gasket sections 164, each removably attached by attachment means to the jacketed encapsulated support frame assembly 75 shown in FIG. 22B (preferably attachment means are cooperating hook pads and loop pads of well understood hook and loop attachment pad systems with a hook pad attached to one surface to be joined and a loop pad attached to the other surface to be joined; attachment means could also include cooperating pairs of permanent magnetic strips with a first magnetic strip attached to one surface to be joined and a second magnetic strip attached to the other surface to be joined; attachment means could also include use of a suitable adhesive to join surfaces together)
Figure 26:
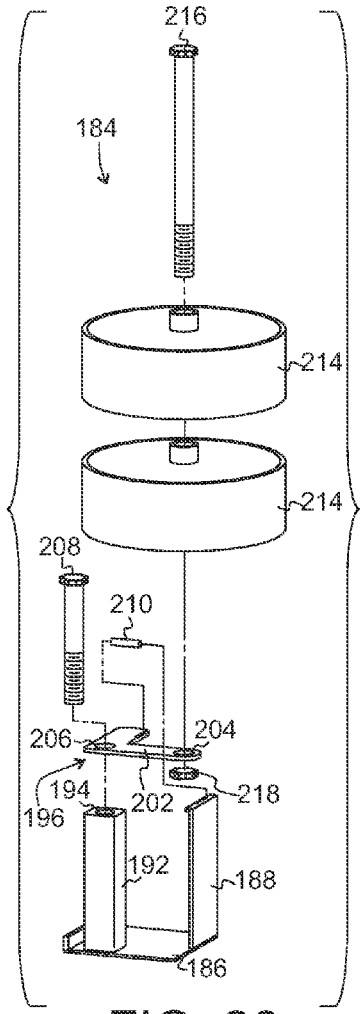
FIG. 26 a partially exploded perspective view of a stay roller assembly 184.
Figure 27:
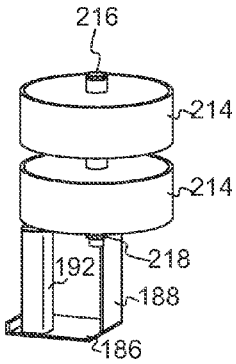
FIG. 27 a perspective view of the stay roller assembly 184 shown in FIG. 26.
Figure 28:
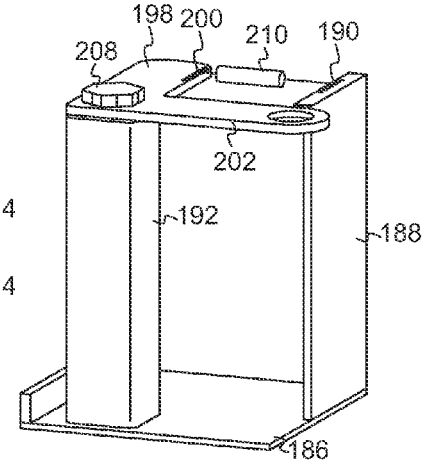
FIG. 28 is partial perspective view of a portion of the stay roller assembly 184 shown in FIG. 27.
Figure 29:
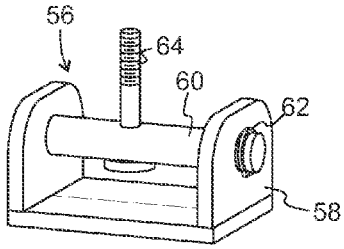
FIG. 29 is a perspective view of a door hanger assembly 56.
Figure 30:
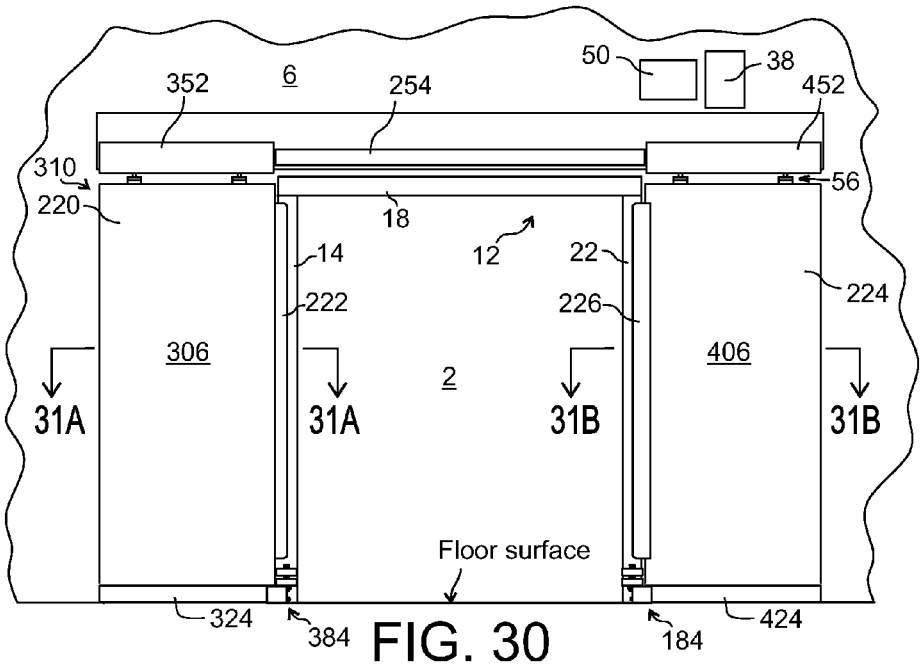
FIG. 30 is a front-side view of an alternative flexible door panel cold storage door system 310 having a flexible door panel having a left flexible door leaf 220 and a right flexible door leaf 224 shown in an open position with stay roller assembly 184 and cooperating stay roller assembly 384 shown.
Figure 31A:
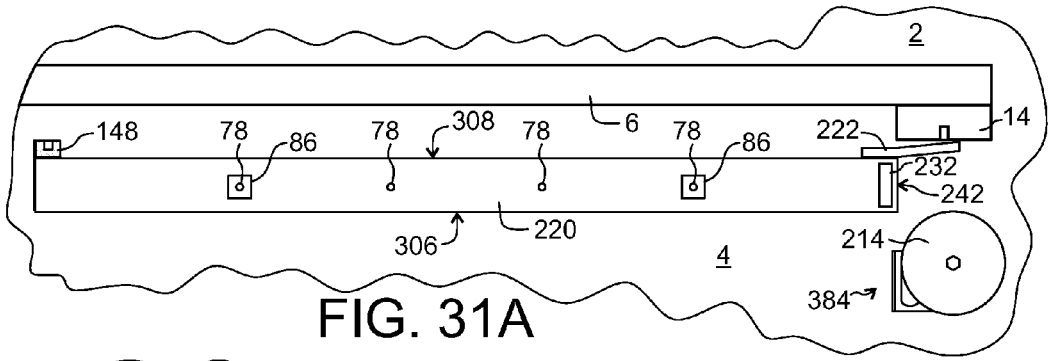
FIG. 31A is a partial cross-sectional view along the line of 31A-31A in FIG. 30 of a lower portion of the alternative flexible door panel cold storage door system showing the left flexible door leaf 220 in an open position alongside a boundary wall 6 between a cold space 2 and a warm space 4.
Figure 31B:
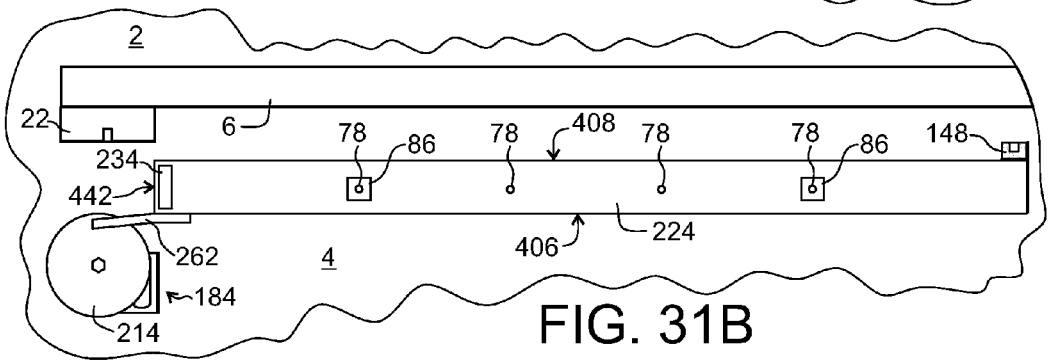
FIG. 31B is a partial cross-sectional view along the line of 31B-31B in FIG. 30 of a lower portion of the alternative flexible door panel cold storage door system showing the right flexible door leaf 224 in an open position alongside a boundary wall 6 between a cold space 2 and a warm space 4.
Figure 32:
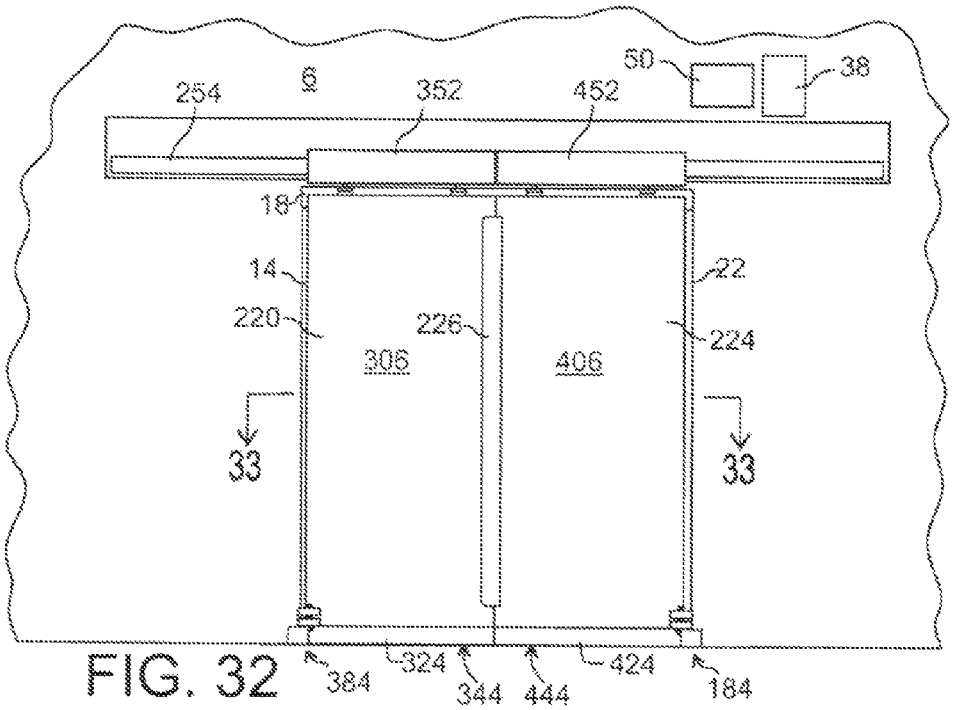
FIG. 32 is a front-side view of the alternative flexible door panel cold storage door system, shown in FIG. 30, having a flexible door panel having a left flexible door leaf 220 and a right flexible door leaf 224 shown in a closed position.
Figure 33:
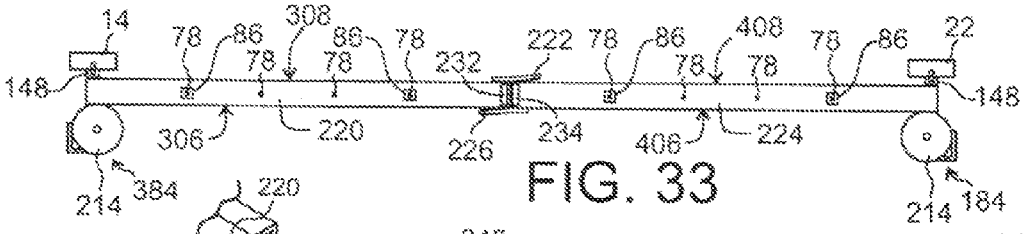
FIG. 33 is a partial cross-sectional view along the line of 33-33 in FIG. 32 of a lower portion of the alternative flexible door panel cold storage door system shown in a closed position and showing a left leaf sealing flap 222 overlapping a portion of the right flexible door leaf 224, a right leaf sealing flap 226 overlapping a portion of the left flexible door leaf 220, and showing a left leaf cooperating sealing and closing magnet strip 232 in facing proximity to a right leaf cooperating sealing and closing magnet strip 234.
Figure 34:
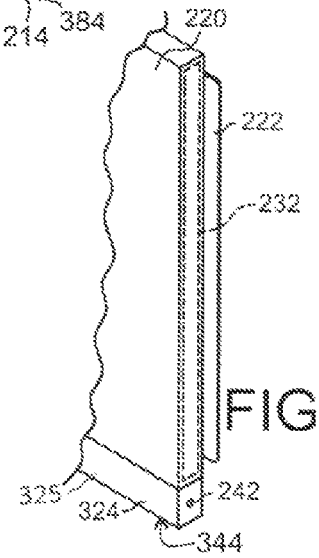
FIG. 34 is a partial perspective view of a left flexible door leaf 220 showing a communicating interface air port 242 in a left leaf bottom sweep assembly 324 that communicates with a left leaf bottom sweep assembly air channel 344 and that in the closed position cooperates and communicates with a corresponding abutting interface air port 442 in a right leaf bottom sweep assembly 424 to allow airflow between the two leaf bottom sweep assembly air channels.

Referring to FIGS. 24 and 25, preferably, there are two bottom sweep gasket sections 164 removably attached by attachment means to at least one cold space surface perimeter hook pad 146 respectively along bottom portions of a left periphery and a right periphery of the cold space surface 108.

Figure 5A:
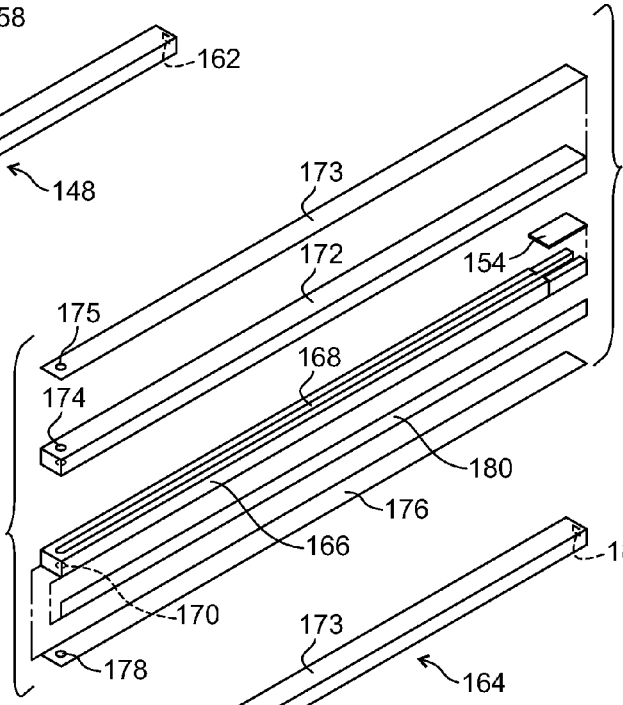
FIG. 5A is an exploded perspective view of a bottom sweep gasket section 164.
Figure 5B:
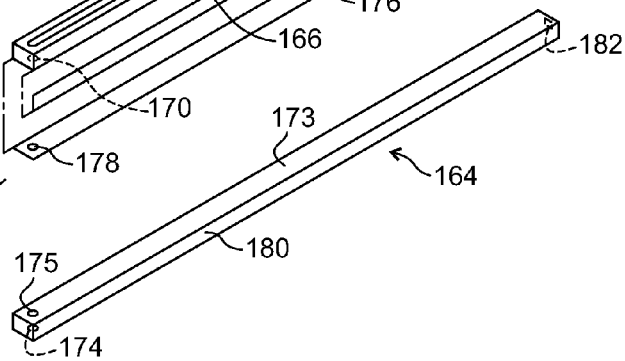
FIG. 5B is a perspective view of the bottom sweep gasket section 164 shown in FIG. 5A.
Figure 6:
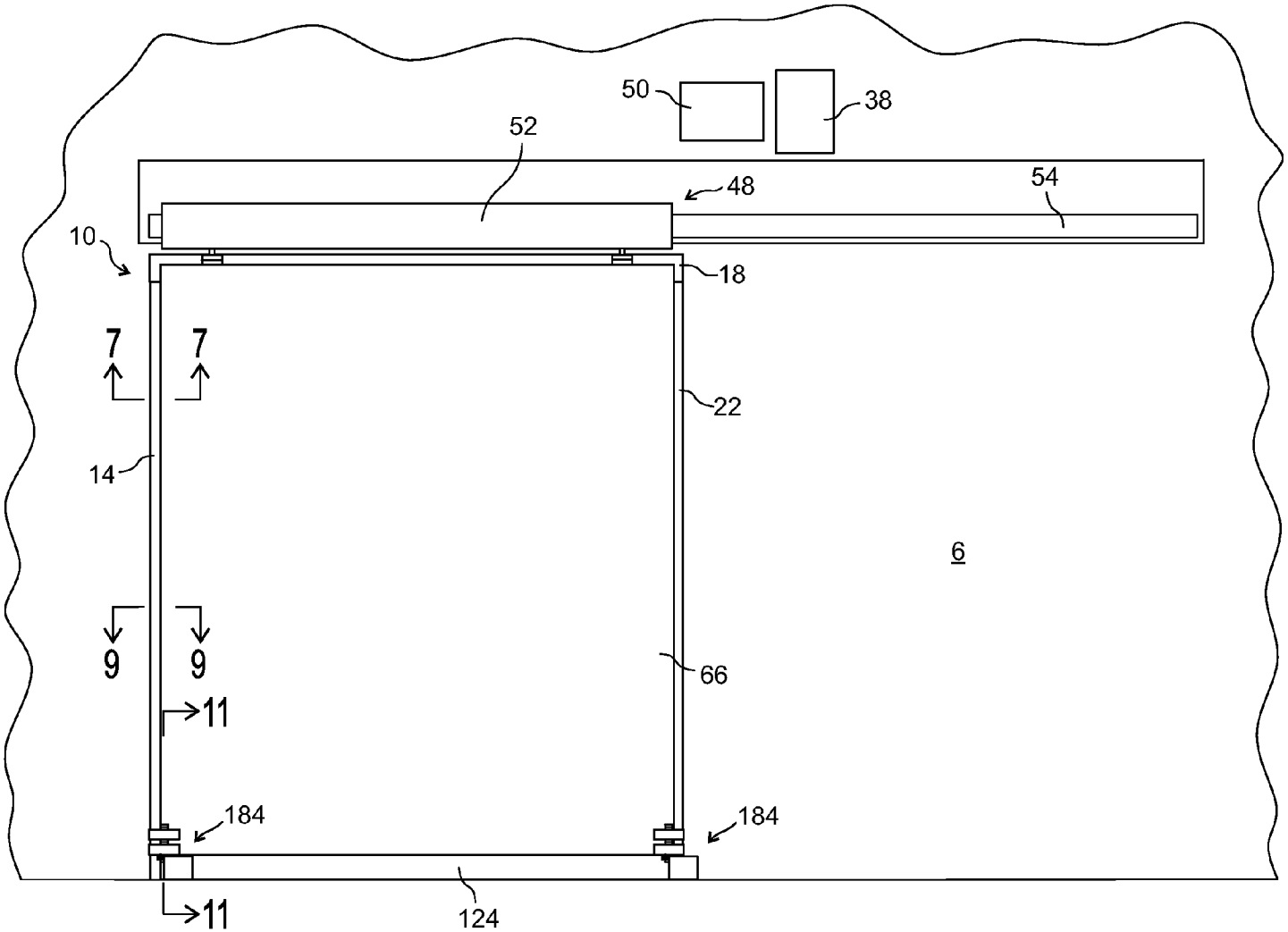
FIG. 6 is a front-side view of the flexible door panel cold storage door system 10 of the preferred embodiment showing the flexible door panel 66 in a closed position and showing two stay roller assemblies 184.
Figure 7:
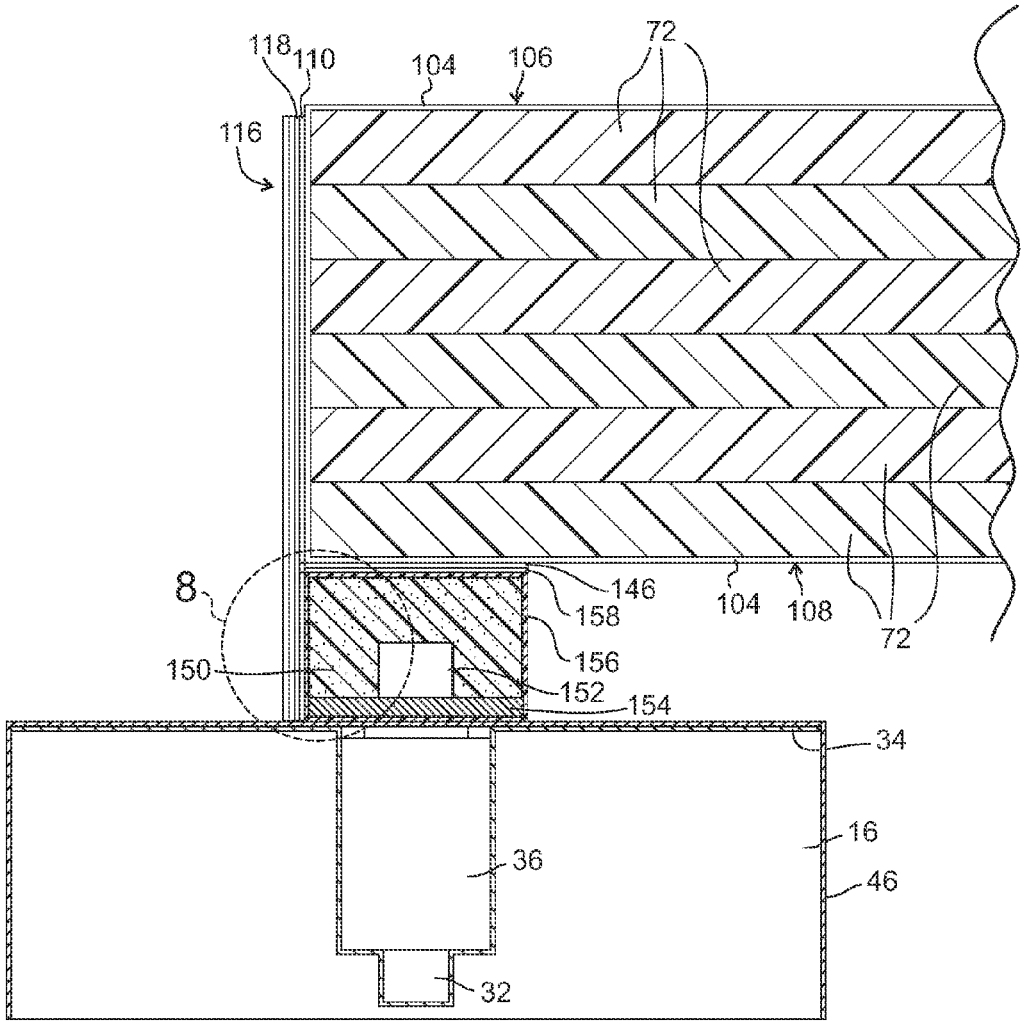
FIG. 7 is a partial cross-sectional view along the line of 7-7 in FIG. 6 of an upper portion of the flexible door panel cold storage door system 10.
Figure 8:
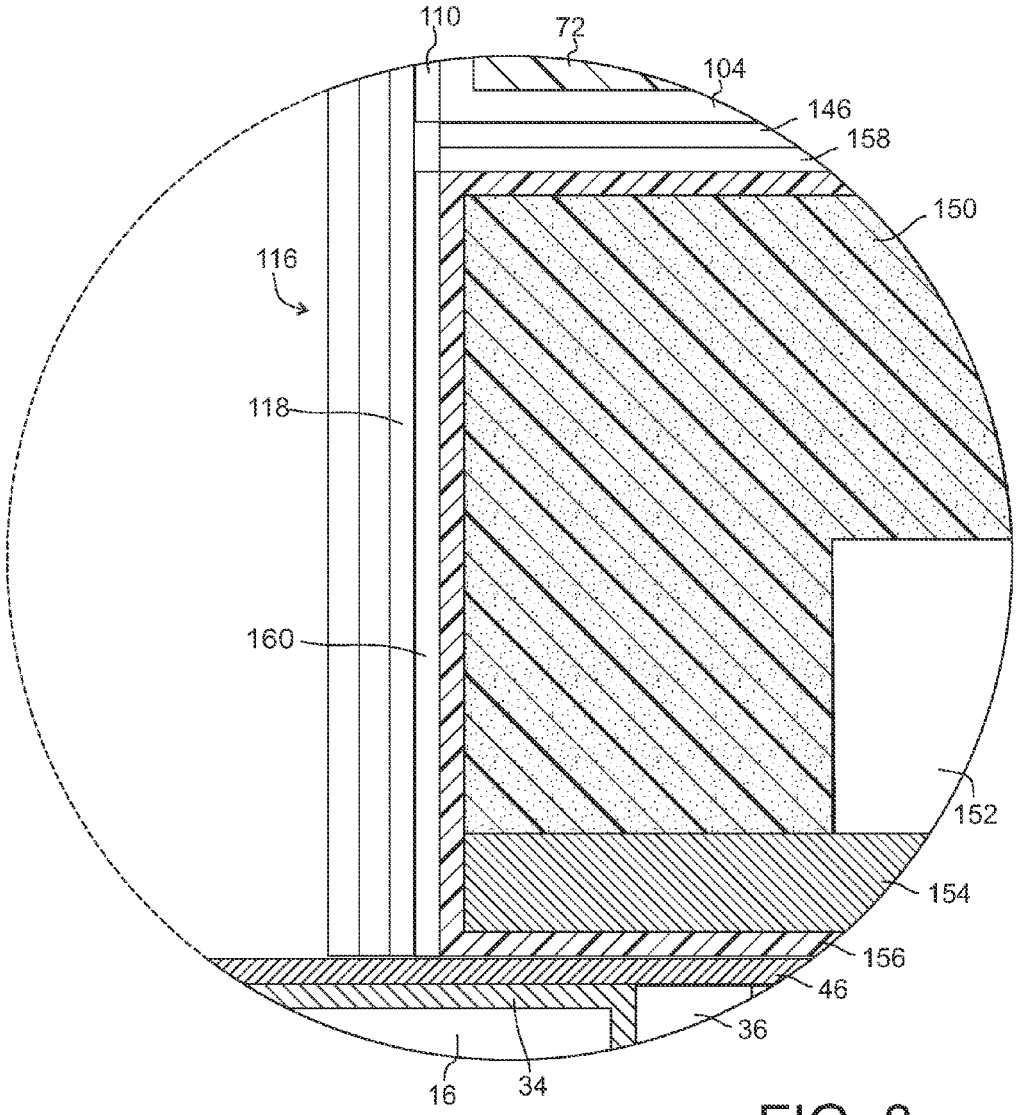
FIG. 8 is an enlarged view of an indicated portion of FIG. 7.
Figure 9:
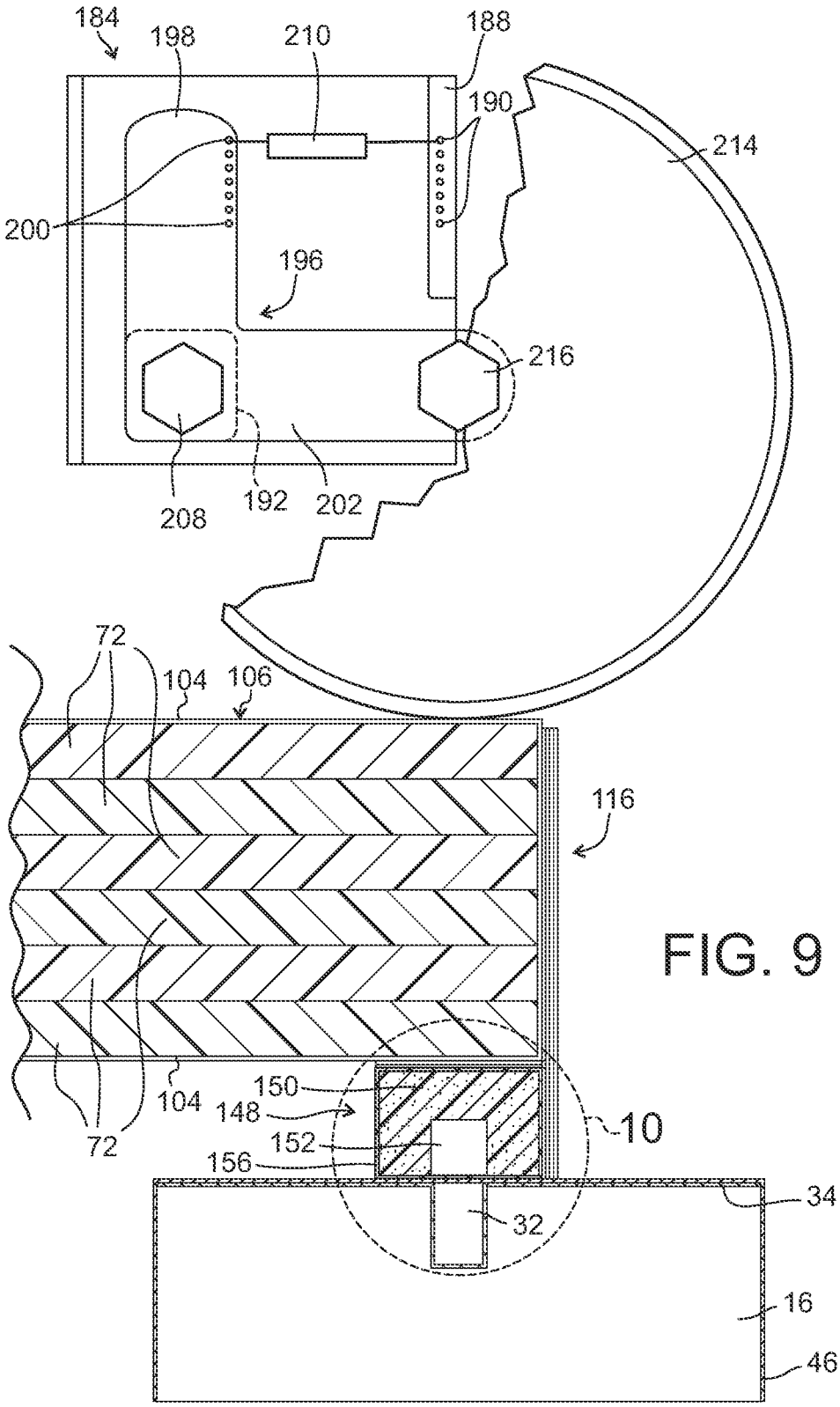
FIG. 9 is a partial cutaway cross-sectional view along the line of 9-9 in FIG. 6 of a lower portion of the flexible door panel cold storage door system 10 showing a partially cutaway stay roller assembly 184 and showing a portion of a sealing zone that lies between a plurality of gasket sections and a nonferrous doorframe outer jacket 46 (bottom sweep assembly not shown)
Figure 10:
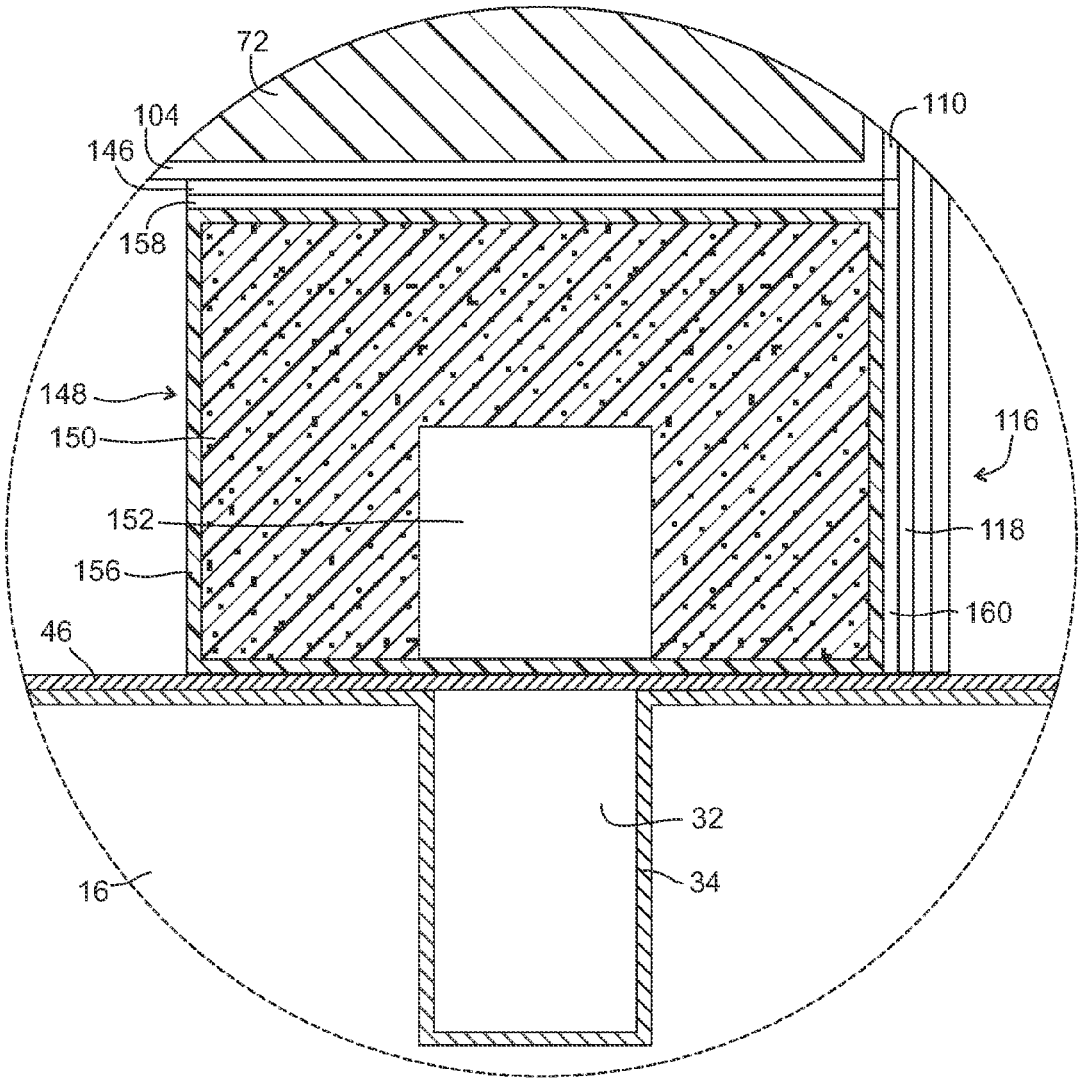
FIG. 10 is an enlarged view of an indicated portion of FIG. 9.

In the best embodiment, see FIGS. 5A and 5B, each bottom sweep gasket section 164 is an elongate insulating member having a substantially rectangular cross-section and having a bottom sweep gasket section core 166 made from an extruded insulating foam or some other suitable insulating material; a bottom sweep gasket section air channel 168 having a closed end at the bottom sweep gasket section core's bottom end is formed substantially along the longitudinal length away from the closed end and along the midline of the bottom sweep gasket section's top core surface, a bottom sweep gasket section core air port 170 is formed transverse through the sweep gasket section core near the closed end; a bottom sweep gasket section outer jacket 172 substantially covers and overlays the sweep gasket section core, the sweep gasket section air channel, and the sweep gasket section core air port; the sweep gasket section outer jacket has a bottom sweep gasket section transverse bore 174 and the gasket section transverse bore communicates with the sweep gasket section air channel and the sweep gasket section core air port.

Figure 11:
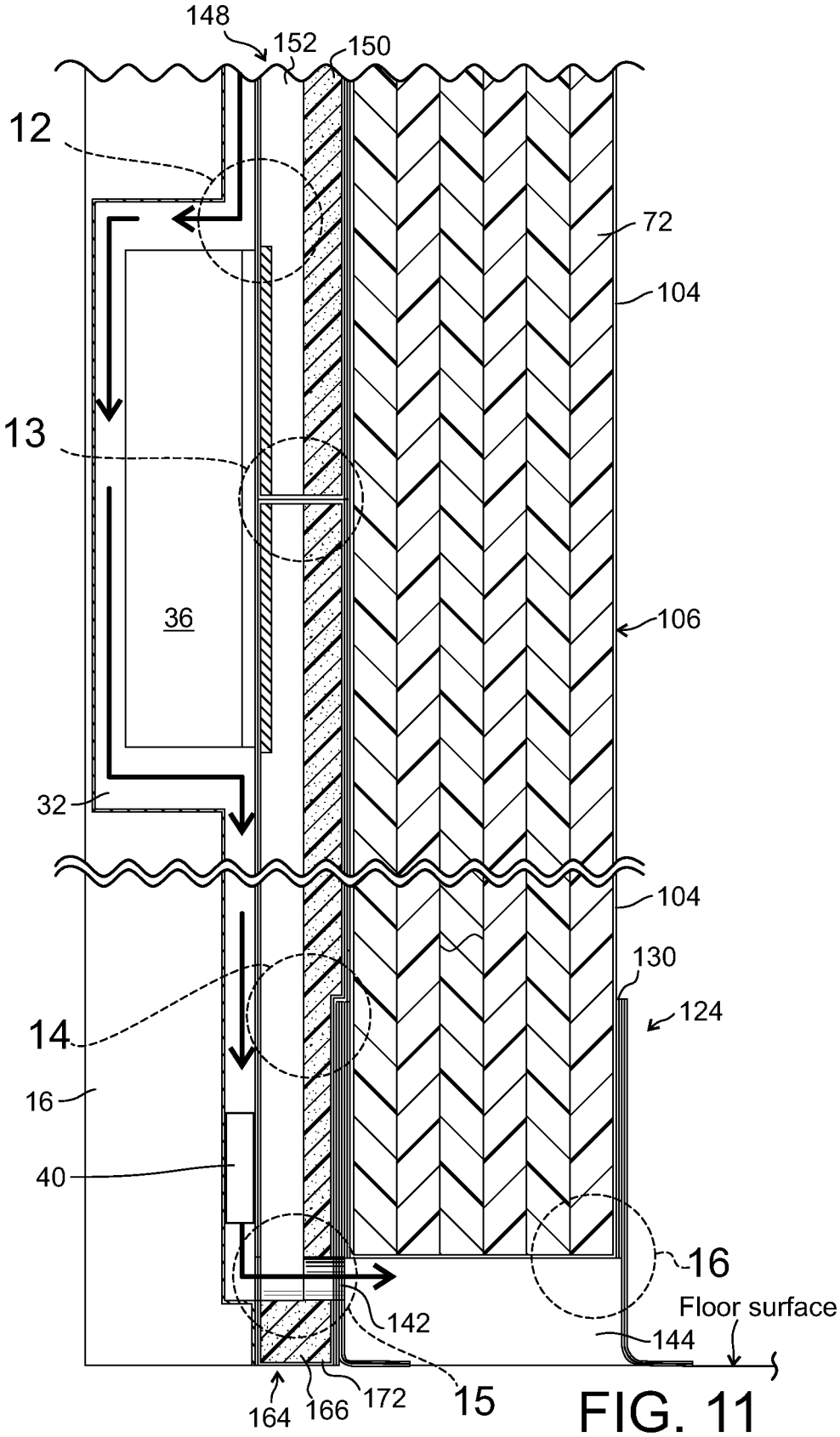
FIG. 11 is a partial cross-sectional view along the line of 11-11 in FIG. 6 of a lower portion of the flexible door panel cold storage door system 10 unlabeled arrows depict airflow through the frame core ventilation channel 32; stay roller assembly not shown; a bottom sweep assembly 124 is shown compressed against the floor surface.
Figure 12:
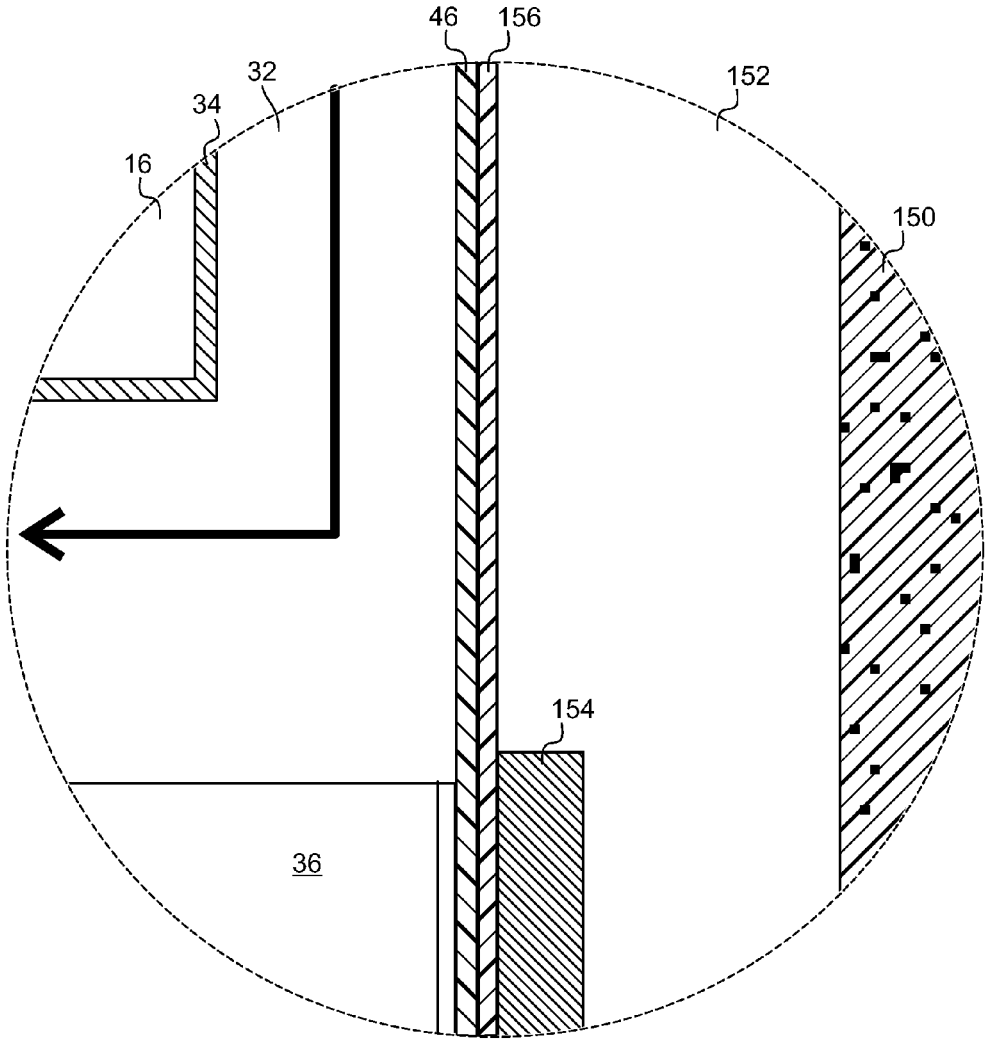
FIG. 12 is an enlarged view of an indicated portion of FIG. 11 unlabeled arrow depicts airflow.
Figure 13:
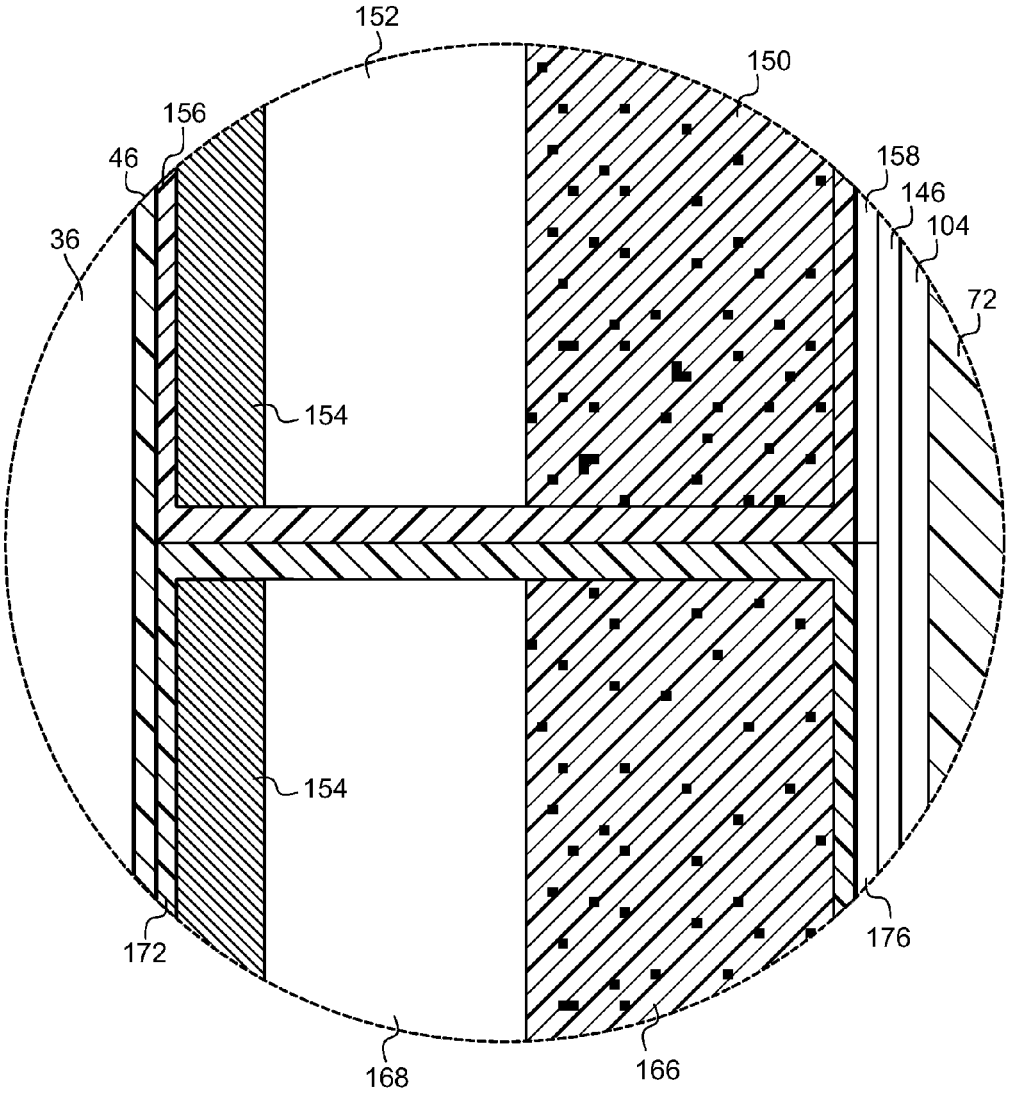
FIG. 13 is an enlarged view of an indicated portion of FIG. 11.
Figure 14:
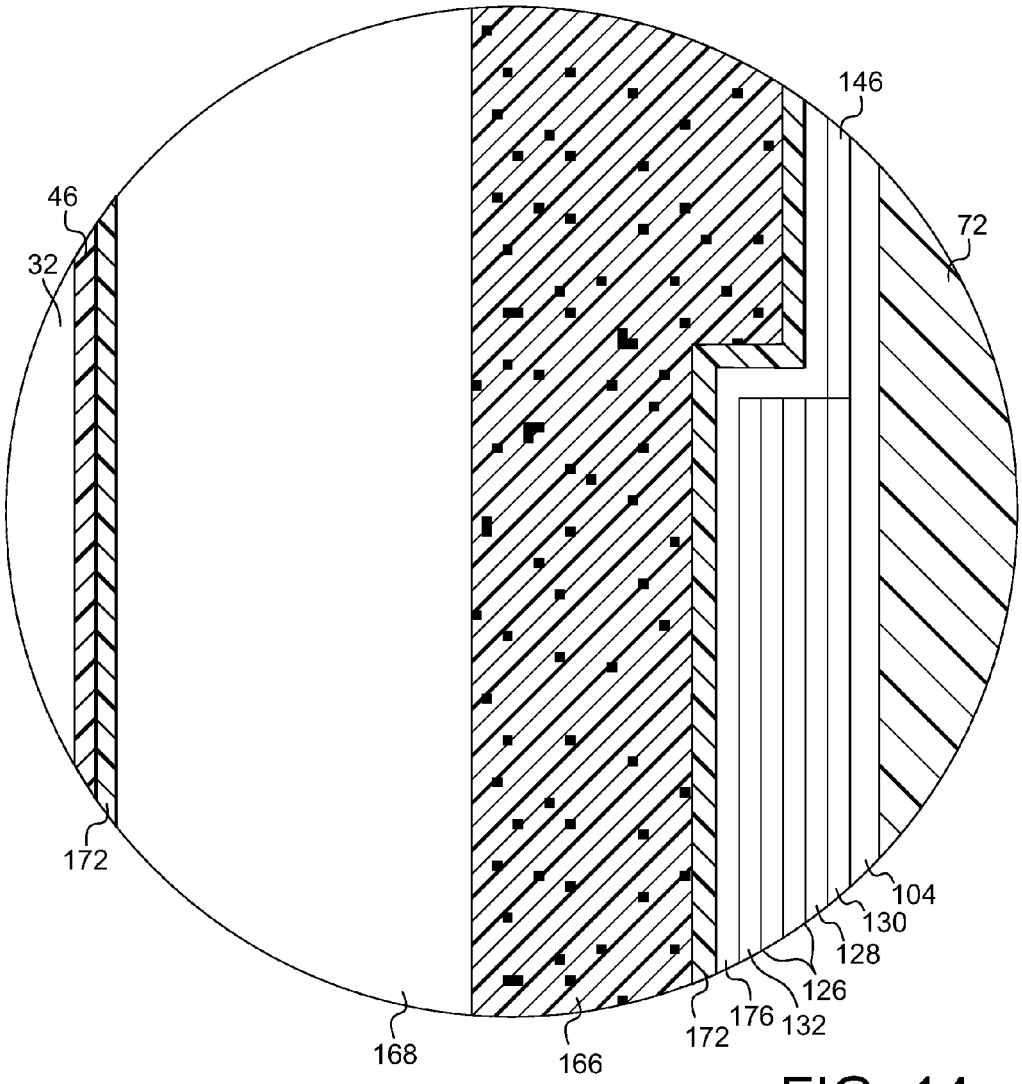
FIG. 14 is an enlarged view of an indicated portion of FIG. 11.
Figure 15:
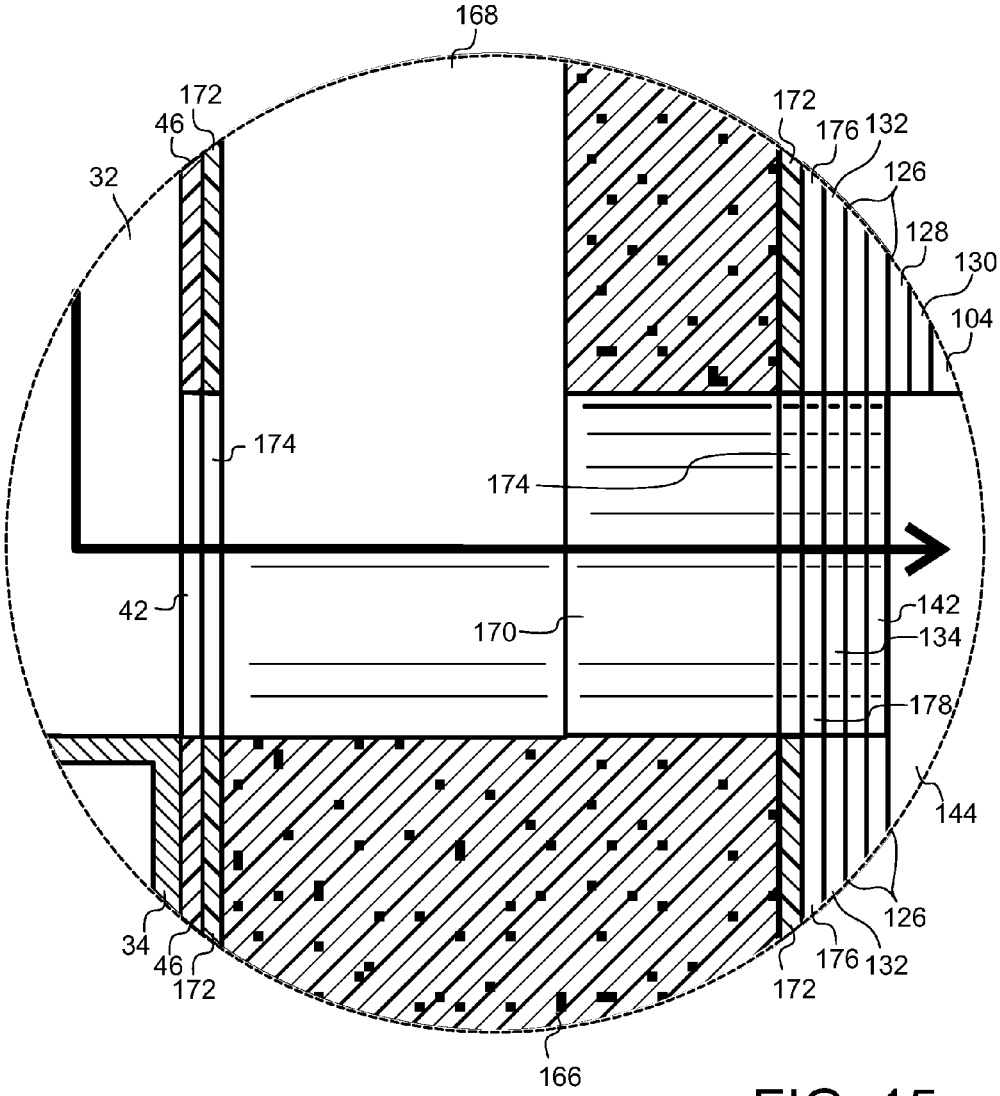
FIG. 15 is an enlarged view of an indicated portion of FIG. 11 unlabeled arrow depicts airflow from the ventilation channel 32 through a bottom sweep gasket transverse bore 174 and into a bottom sweep assembly air channel 144.
Figure 16:
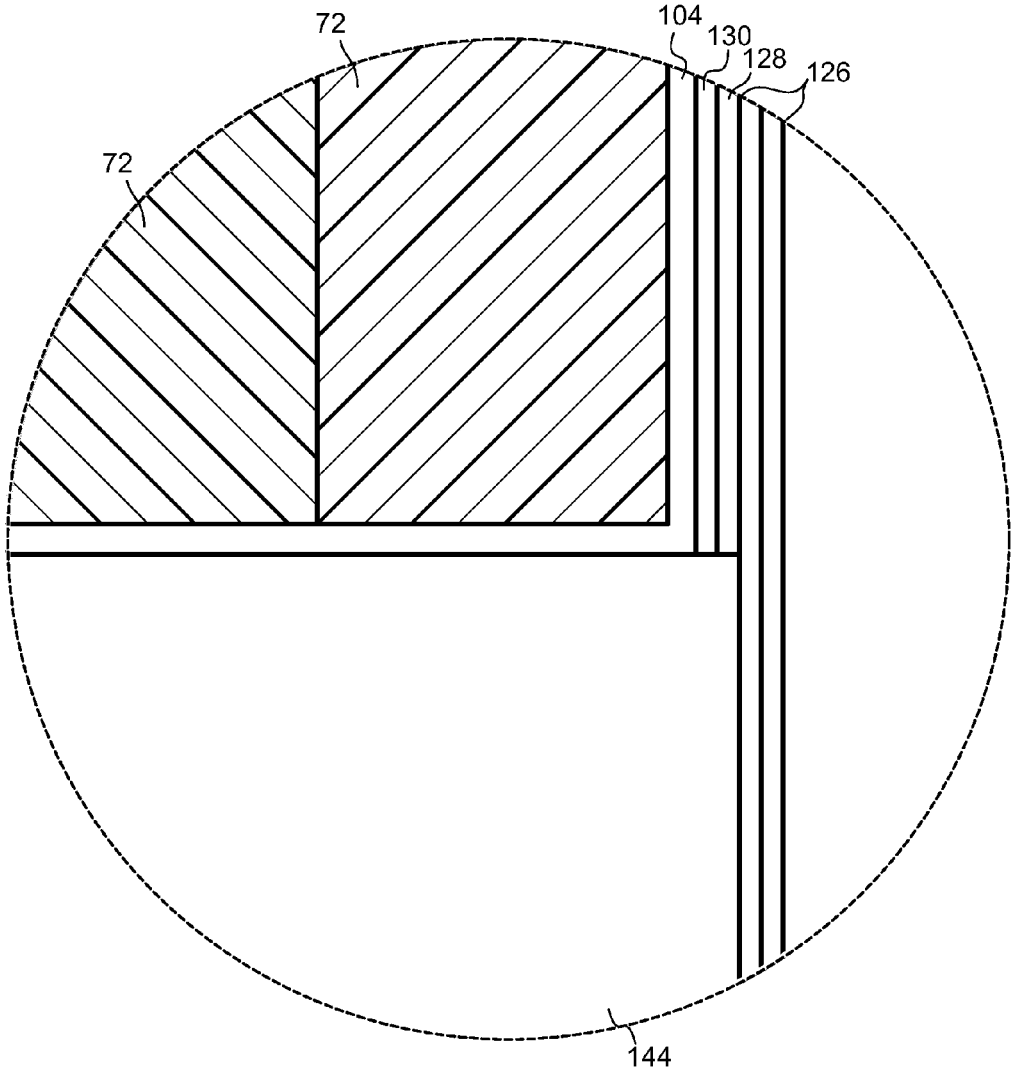
FIG. 16 is an enlarged view of an indicated portion of FIG. 11.
Figure 17:
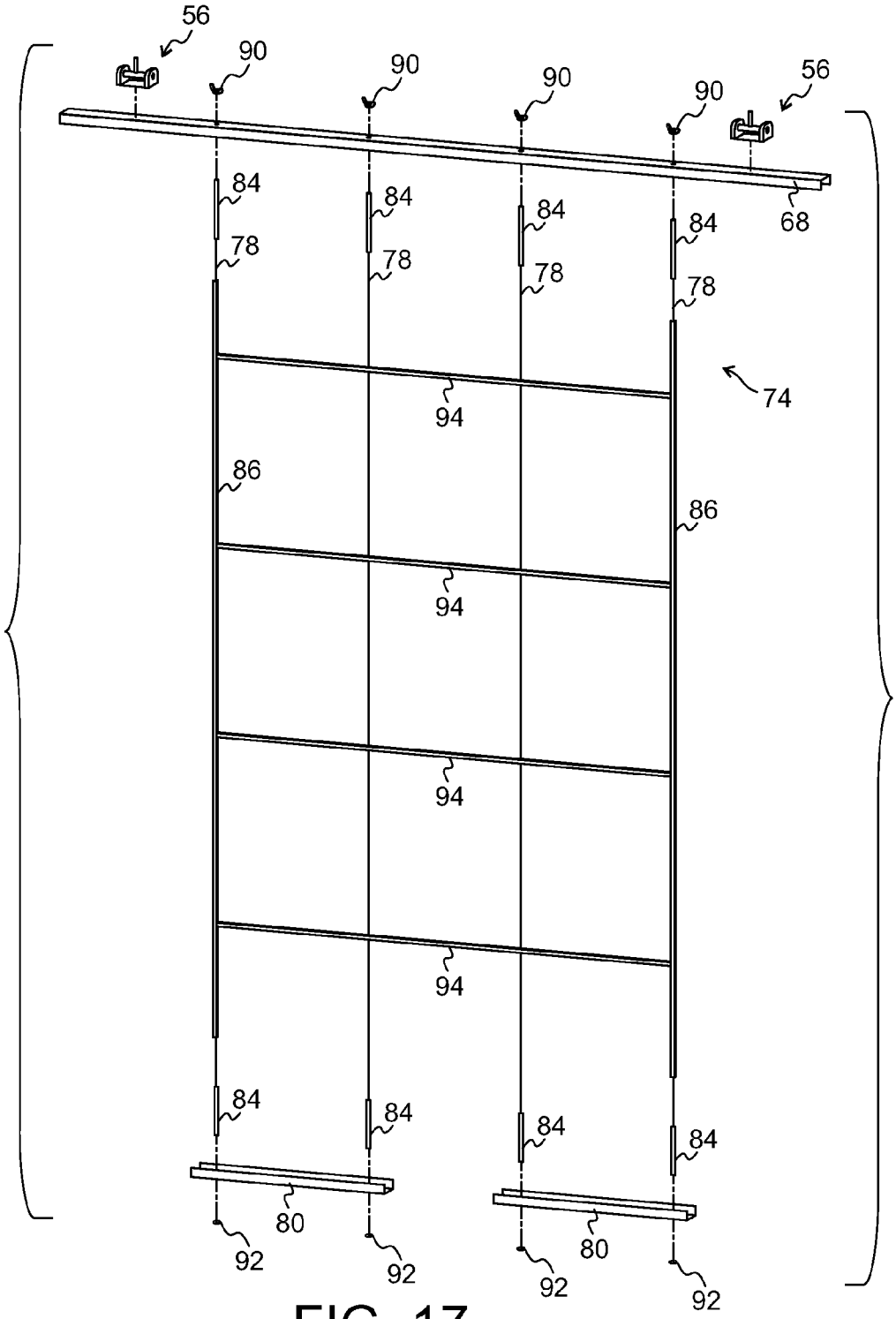
FIG. 17 is a partially exploded perspective view of a support frame assembly 74.
Figure 18:
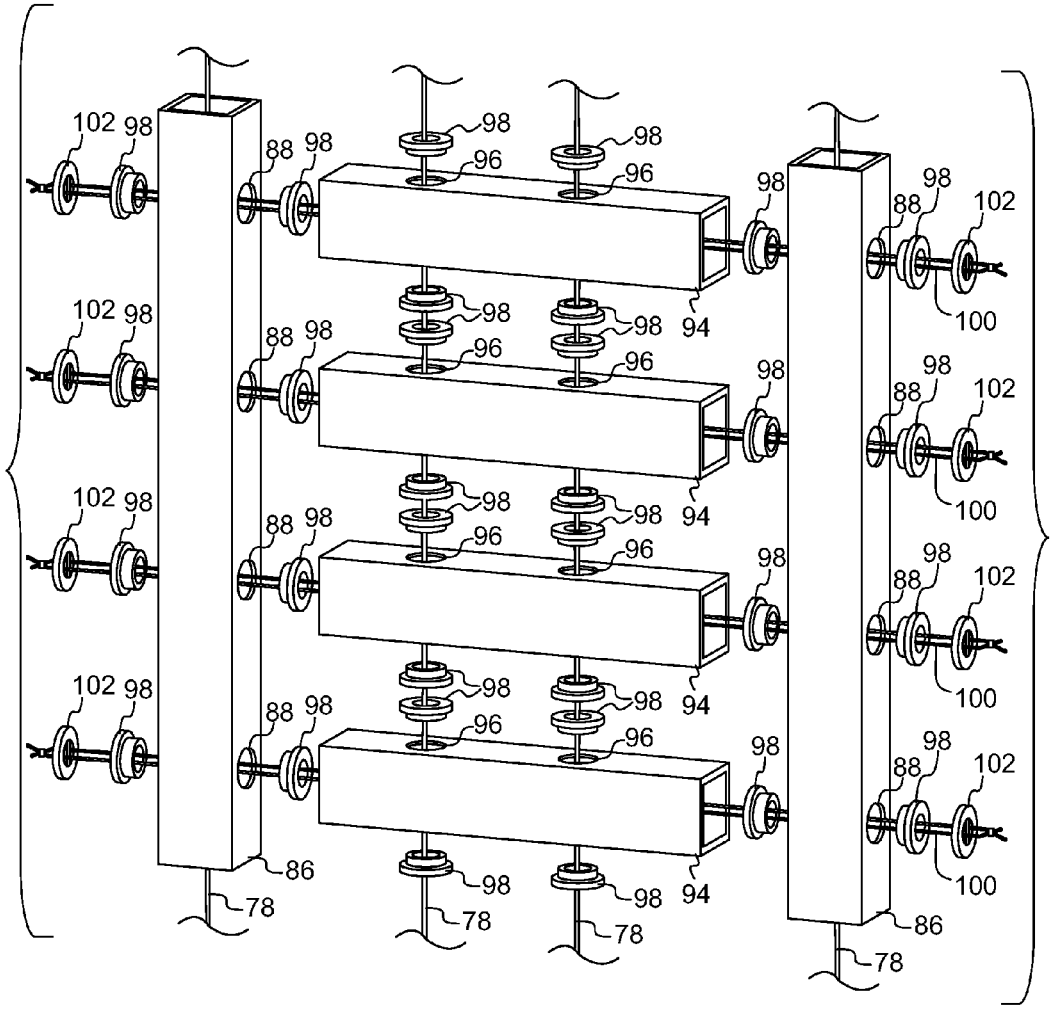
FIG. 18 is a partial exploded perspective view of the support frame assembly 74 shown in FIG. 17 (not to the same scale)
Figure 19:
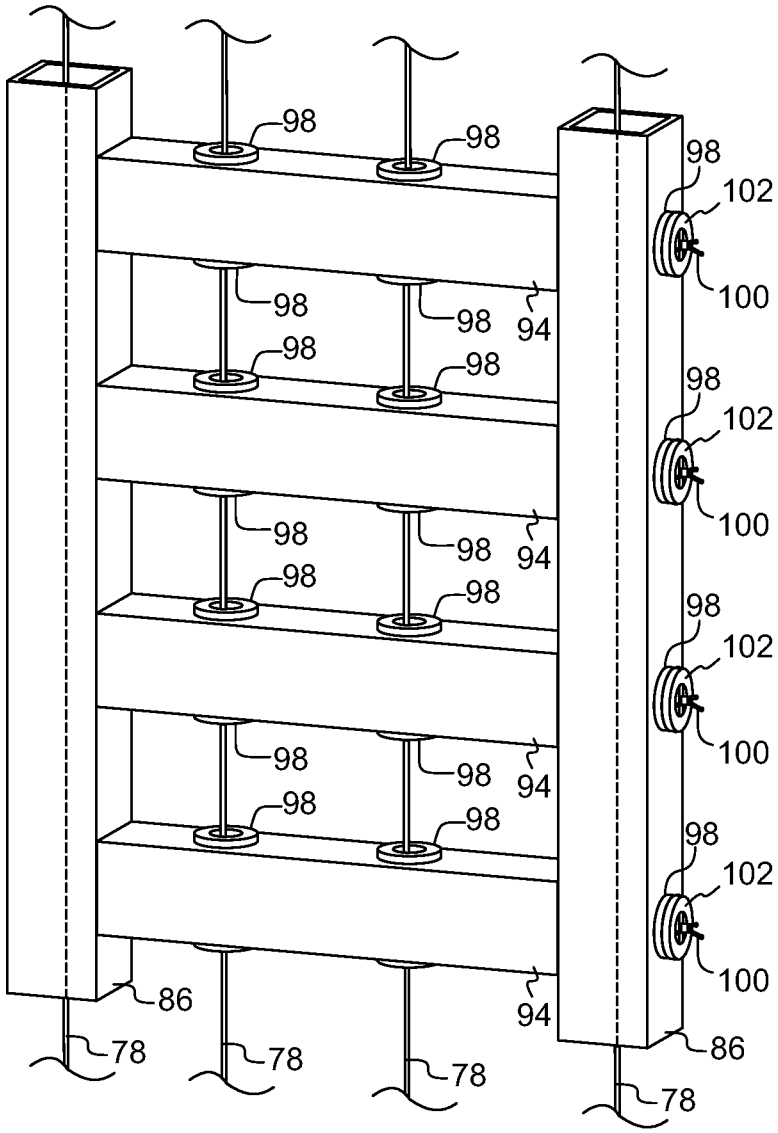
FIG. 19 is a partial perspective view of the support frame assembly 74 shown in FIG. 17 (not to the same scale)

Preferably, referring to FIG. 11, each bottom sweep gasket section 164 has at least one ferrous gasket target 154 located proximate the gasket section's top surface spaced away from the door panel jacket 104 and towards the doorframe outer jacket 46 and each ferrous gasket target aligned to cooperate and be magnetically attracted by and towards one of the electromagnets 36 when the door panel 66 is in the closed position and the electromagnets are energized.

Preferably, referring to FIGS. 5A and 5B, each bottom sweep gasket section 164 has a bottom sweep gasket section loop pad 176 attached along the bottom sweep gasket section's bottom length, a bottom sweep gasket section hook pad 180 attached along an adjacent side length, and an insulating strip 173 attached along the bottom sweep gasket section's top length; the sweep gasket section loop pad having a loop pad aperture 178 and the insulating strip having an insulating strip aperture 175, the loop pad aperture and the insulating strip aperture aligned and communicating with the sweep gasket section transverse bore 174 to allow air flow through the aligned openings.

FIG. 5B shows an optional sweep gasket section end port 182 in and through the sweep gasket section outer jacket 172 that communicates with the sweep gasket section air channel 168 and the sweep gasket section end port may communicate with a corresponding intermediate gasket section end port 162 in an adjacent intermediate gasket section 148.

Referring to FIGS. 24 and 25, preferably, there are a plurality of intermediate gasket sections 148 removably attached by attachment means respectively to at least one perimeter hook pad 146 along contiguous portions of a left periphery, a top periphery, and a right periphery of the cold space surface 108 contiguous one to another and between and contiguous to two bottom sweep gasket sections 164.

Figure 4A:
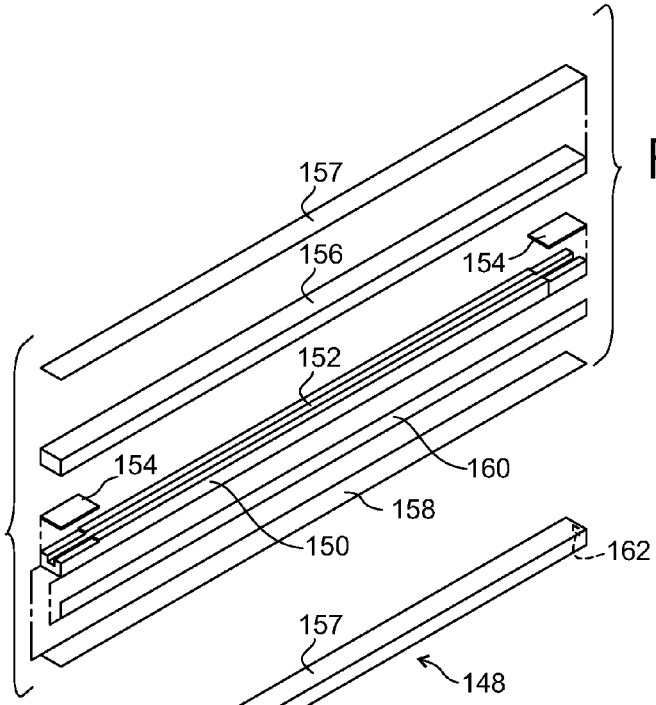
FIG. 4A is an exploded perspective view of an intermediate gasket section 148.
Figure 4B:
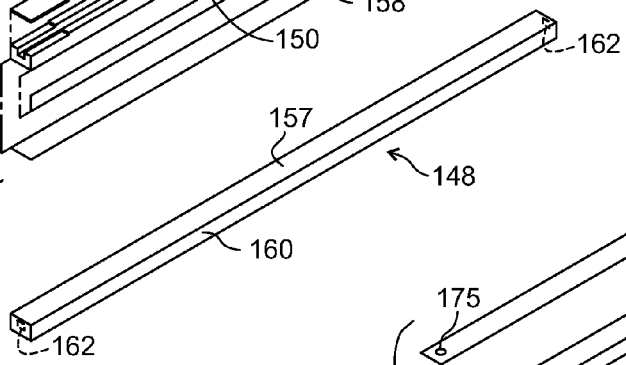
FIG. 4B is a perspective view of the intermediate gasket section 148 shown in FIG. 4A.

In the best embodiment, see FIGS. 4A and 4B, each intermediate gasket section 148 is an elongate insulating member having a substantially rectangular cross-section and having an intermediate gasket section core 150 made from an extruded insulating foam or some other suitable insulating material; an intermediate gasket section air channel 152 is formed substantially along the longitudinal length and the midline of the intermediate gasket section's top core surface; an intermediate gasket section outer jacket 156 substantially covers and overlays the intermediate gasket section core, and the intermediate gasket section air channel.

Preferably, referring to FIG. 11, each intermediate gasket section 148 has at least one ferrous gasket target 154 located proximate the gasket section's top surface spaced away from the door panel jacket 104 and towards the doorframe outer jacket 46 and each ferrous gasket target aligned to cooperate and be magnetically attracted by and towards one of the electromagnets 36 when the door panel 66 is in the closed position and the electromagnets are energized.

Preferably, referring to FIGS. 4A and 4B, each intermediate gasket section 148 has an intermediate gasket section loop pad 158 attached along the intermediate gasket section's bottom length, an intermediate gasket section hook pad 160 attached along an adjacent side length, and an insulating strip 157 attached along the intermediate gasket section's top length.

FIG. 4B shows two optional intermediate gasket section end ports 162 in and through each end of the intermediate gasket section outer jacket 156 that communicate with the intermediate gasket section air channel 152 and each intermediate gasket section end port may communicate with a corresponding intermediate gasket section end port 162 in an adjacent intermediate gasket section 148 or with a corresponding sweep gasket section end port 182 in an adjacent bottom sweep gasket section 164.

Referring to FIGS. 7-10, 24, and 25, a panel jacket side skirt assembly 116 comprises in the best embodiment a two layer fabric strip having a panel jacket side skirt loop pad 118 attached along one side.

In the best embodiment of a fully-assembled invention, two panel jacket side skirt assemblies 116 are removably attached respectively each to one of two panel jacket side surfaces by means of at least one panel jacket side surface hook pad 110 on each side surface engaging a respective side skirt loop pad 118. Preferably, each side skirt loop pad 118 also engages portions of intermediate gasket section hook pads 160 adjacent a respective side surface hook pad 110 and also engages portions of a bottom sweep gasket section hook pad 180 adjacent a respective side surface hook pad 110.

Referring to FIGS. 24, and 25, a top skirt assembly 120 comprises in the best embodiment a two layer fabric strip having a top skirt loop pad 122 attached along one side.

In the best embodiment of a fully-assembled invention, the top skirt assembly 120 is removably attached to the panel jacket top surface by means of at least one panel jacket top surface hook pad 112 attached to the panel jacket top surface removably engaging the top skirt loop pad 122. Preferably, two panel jacket top surface end hook pads 114 also engage the top skirt loop pad 122. Preferably, each top skirt loop pad 122 also engages portions of intermediate gasket section hook pads 160 adjacent the top surface hook pad 112 and also engages portions of intermediate gasket section hook pads 160 adjacent a respective top surface end hook pad 114.

Referring to FIGS. 6, 9, 26-28, 30, 31A, 31B, 32, and 33, at least one and preferably two stay roller assemblies 184, and/or 384 can adjustably assist in maintaining the door panel 66 or the leaves 220 and 224 in proximity to a nonferrous doorframe outer jacket 46 by applying adjustable pressure inwardly against a respective warm space surface 106 of a door panel jacket or a leaf jacket. A cooperating stay roller assembly 384 is a mirror version of the stay roller assembly 184.

Each stay roller assembly 184 or 384 has a base plate 186; a spring attachment wall 188 depending upward from an edge of the base plate, a plurality of spaced spring attachment holes 190 distributed along an upper edge of the spring attachment wall; a pressure arm support post 192 depending upward from the base plate, a pivot bolt mounting bore 194 in the support post; an L-shaped pressure arm 196 having a spring adjustment leg 198 and a stay roller attachment leg 202, a plurality of spaced spring adjustment holes 200 distributed along the spring adjustment leg, a stay roller attachment bore 204 near the free end of the attachment leg; and a transverse arm mounting bore 206 located between the two legs; a pressure arm pivot bolt 208 engaged in the pivot bolt mounting bolt rotatably mounts the pressure arm to the support post; at least one pressure spring 210 is selectively mounted between one of the spring attachment holes and one of the spring adjustment holes; at least one stay roller 214 is rotatably mounted in the arm mounting bore at the outer end of the stay roller attachment leg by a stay roller bolt 216 and a stay roller nut 218.

Referring to FIGS. 30 through 34, an alternative flexible door panel cold storage door system 310 has a doorframe assembly 12, having a vertical left frame 14, a horizontal top frame 18, and a vertical right frame 22, mounted to or in a boundary wall 6 to contiguously define together with a floor surface between the left frame and the right frame a door opening; the left frame having a left frame core; the top frame having a top frame core; the right frame having a right frame core; each frame core having a frame core top surface and a longitudinal top surface centerline; a plurality of open electromagnet wells in the frame cores distributed along and proximate to the centerlines; a frame core ventilation channel formed in the frame core top surfaces, the ventilation channel having a first end near the left frame core's bottom end and the ventilation channel contiguously and serially communicating to and through each well in each frame core and the ventilation channel having a second end near the right frame core's bottom end; a heat dispersion layer proximately lining the wells and the ventilation channel and substantially covering the frame core top surfaces, a plurality of electromagnets operably mounted one electromagnet in each well and mounted substantially flush to the adjacent frame core top surface; a nonferrous doorframe outer jacket attached to and substantially covers the frames, the ventilation channel, and the electromagnets; each electromagnet selectively energized by a D/C power supply 38 electrically connected to the electromagnets; the power supply selectively controlled by a control box 50; and two air ventilation ports through the outer jacket and the ventilation ports communicating with the ventilation channel and with one port located proximate the first end and the other port located proximate the second end.

The alternative flexible door panel cold storage door system 310, further has a movable flexible door panel comprising a left flexible door leaf 220 and a right flexible door leaf 224, the leaves engageable at an abutting interface between abutting edges of the leaves, each leaf having a leaf jacket and having a leaf jacket periphery and each leaf selectively disposable against the doorframe outer jacket to at least partially block the door opening when in a respective closed position, each leaf substantially unblocking the door opening when in a respective open position; each leaf jacket having an upper end and a lower end; two bottom sweep gasket sections removably attached by attachment means one to each of the leaf jackets proximate the lower end along the leaf jacket periphery that overlaps a portion of the doorframe outer jacket when the door panel is in the closed position with one bottom sweep gasket section located proximate the first end and the other bottom sweep gasket section located proximate the second end; a plurality of intermediate gasket sections removably and contiguously attached by attachment means to each leaf jacket proximate and along a contiguous portion of each leaf jacket periphery that overlaps a contiguous portion of the doorframe outer jacket when the leaves are in respective closed positions and the gasket sections operably configured to form an air seal with the doorframe outer jacket when the leaves are in the closed position; and each gasket section having at least one ferrous gasket target located proximate the gasket section's surface spaced away from the leaf jacket and towards the doorframe outer jacket and each ferrous gasket target aligned to cooperate and be magnetically attracted by one of the electromagnets when the leaves are in respective closed positions and the electromagnets are energized.

In the alternative flexible door panel cold storage door system 310, each leaf 220, 224 has a support frame assembly having a header spaced from and connected to at least one door panel base plate segment by at least two spaced vertical suspension cables 78, each suspension cable threaded lengthwise through and retained respectively in one of at least two vertical tube stiffeners 86; at least one horizontal tube stiffener attached proximately and elastically to and perpendicularly between the two vertical tube stiffeners; a plurality of flexible insulation sheets facing one another with at least one insulation sheet on each side of the frame assembly and the insulation sheets supported by the frame assembly; the leaf jacket encapsulating the support frame assembly and the insulation sheets; and at least two door hanger assemblies 56 spaced and coaxially aligned and attached proximate the upper end to the header; an overhead horizontal track and carriage system comprising: an overhead horizontal track 254 mounted across the top frame 18; two carriage assemblies 352, 452 movably mounted to the horizontal track; each leaf suspended respectively by at least two door hanger assemblies 56 from one of carriage assemblies; and each leaf movable between the respective closed position and the respective open position; each leaf having a lower end attachment hook strip attached to, about, and encircling the lower end; each leaf having a bottom sweep assembly 324, 424 having a bottom sweep attachment loop strip; the respective bottom sweep attachment loop strip removably attached to the respective lower end attachment hook strip and encircling the respective lower end; a respective depending wall portion 325 of the respective bottom sweep assembly extends downward beyond the respective lower end to slidingly engage the floor surface in the door opening; the respective lower end, the respective depending wall portion 325, and the floor surface defining a respective bottom sweep assembly air channel 344, 444, and the respective depending wall portion 325 having a respective bottom sweep assembly air port communicating into and out from the respective bottom sweep assembly air channel, and the respective assembly air port aligned and communicating with one of the ventilation ports when the door panel is in the closed position; and each leaf having an interface air port 242, 442 in a portion of the respective bottom sweep assembly in closest proximity to the other leaf and aligned and communicating with the corresponding interface air port in the other leaf when the leaves are in the closed position.

In the alternative flexible door panel cold storage door system 310, an inline ventilation fan is mounted in the ventilation channel; each leaf has a magnet strip 232, 234 incorporated into and along the leaf's abutting edge aligned to magnetically attract the corresponding magnet strip in the other leaf's abutting edge; and each of the leaves has a sealing flap 222, 226 removably attached along a portion of the leaf's abutting edge; and the sealing flaps on opposite faces of the leaves to partially overlap the other leaf when in the closed position.

Preferably, the left flexible door leaf 220 has a left leaf sealing flap 222 attached by cooperating hook and loop attachment pads along a portion of the left flexible door leaf's cold space surface 308 adjacent the abutting interface and extending beyond the abutting interface to partially overlap the right flexible door leaf's cold space surface 408 when the leaves are in the closed position. Preferably, the right flexible door leaf 224 has a right leaf sealing flap 226 attached by cooperating hook and loop attachment pads along a portion of the right flexible door leaf's warm space surface 406 adjacent the abutting interface and extending beyond the abutting interface to partially overlap the left flexible door leaf's warm space surface 306 when the leaves are in the closed position.

Preferably, the left flexible door leaf 220 has a left bottom sweep assembly 324 removably attached to, about, and encircling the lower end of the its leaf jacket; the left bottom sweep assembly having a left bottom sweep assembly air channel 344, the left bottom sweep assembly having a bottom sweep assembly air port that communicates with a ventilation port when the leaf is in the closed position and an interface air port 242 in a portion of the left bottom sweep assembly in closest proximity to the right flexible door leaf 224 and aligned and communicating with the corresponding interface air port 442 in the right flexible door leaf when the leaves are in the closed position.

The right flexible door leaf 224 preferably has a right bottom sweep assembly 424 attached to, about, and encircling the lower end of the its leaf jacket; the right bottom sweep assembly having a right bottom sweep assembly air channel 444, the right bottom sweep assembly having a bottom sweep assembly air port that communicates with a ventilation port when the leaf is in the closed position and an interface air port 442 in a portion of the right bottom sweep assembly in closest proximity to the left flexible door leaf 220 and aligned and communicating with the corresponding interface air port 342 in the left flexible door leaf when the leaves are in the closed position.

In the best embodiment, the frame cores 16, 20, and 24 are wood, composite material, or another suitable material; the nonferrous doorframe outer jacket 46 is stainless steel, aluminum, PVC, or another suitable material; the flexible insulation sheets 72 are cross-linked polyethylene closed cell foam sheets, but could also be Minicel® foam sheets, polypropylene closed cell foam sheets, or another suitable, resilient, flexible insulation sheet known in the art that has a suitable insulating R-value.

In the best embodiment, the header 68 and the base plate segments 80 are made from steel channel, wood, composite material, or another suitable material; the suspension cables 78 are braided steel cables or another suitable cable and having crimped on steel cable end couplers 84 that are threaded; the tube stiffeners 86 and 94 are round or square steel tubing, round or square PVC tubing, or tubing of another suitable material.

In the best embodiment, the door panel jacket 104 is made of a flexible PVC, polyester, nylon, Teflon® coated, silicone impregnated, vinyl, Nomex®, Kevlar®, PBI/Kevlar®, or another suitable fabric; in the alternative embodiment having two leaves, the leaf jackets are made of a flexible PVC, polyester, nylon, Teflon® coated, silicone impregnated, vinyl, Nomex®, Kevlar®, PBI/Kevlar®, or another suitable fabric.

In the best embodiment, the gasket section cores 150 and 166 are made of insulating foam such as Trymer® foam, polyurethane foam, polyisocyanurate foam, polystyrene, or another suitable gasket material; and the gasket outer jackets 156 and 172 are made from a durable material such as PVC, rubber, silicone rubber, stainless steel, aluminum, or another suitable material.

In the best embodiment, the insulating strips 157, 173 can be made from neoprene or another suitable material.

Alternatively, the gasket sections 148 and 168 could be each made of neoprene, PVC, rubber, silicone rubber, cork, or another suitable gasket material known in the art and each gasket section incorporating at least one ferrous gasket target 154.

The door system could also be configured with recessed door handles for manual operation between a closed position and an open position.

In the best embodiment, the door system is substantially mounted to the warm side of the boundary wall, but the door system could also alternatively be substantially mounted to the cold side of the boundary wall.

The preceding description and exposition of the invention is presented for purposes of illustration and enabling disclosure. It is neither intended to be exhaustive nor to limit the invention to the precise forms disclosed. Modifications or variations in the invention in light of the above teachings that are obvious to one of ordinary skill in the art are considered within the scope of the invention as determined by the appended claims when interpreted to the breath to which they fairly, legitimately and equitably are entitled.

I claim:

1. A flexible door panel cold storage door system for selectively blocking and unblocking a door opening in a boundary wall between a cold space and a warm space comprising:

a doorframe assembly, having a vertical left frame, a horizontal top frame, and a vertical right frame mounted to or in said wall to contiguously define together with a floor surface between said left frame and said right frame of said door opening;

said left frame having a left frame core; said top frame having a top frame core; said right frame having a right frame core; each said frame core having a frame core front surface and a longitudinal frame core front surface centerline;

a plurality of open electromagnet wells in said frame cores distributed along and proximate to said centerlines;

a frame core ventilation channel formed in said frame core front surfaces, said ventilation channel having a first end near said left frame core's bottom end and said ventilation channel contiguously and serially communicating to and through each said well in each said frame core and said ventilation channel having a second end near said right frame core's bottom end;

a plurality of electromagnets operably mounted one electromagnet in each said well and mounted substantially flush to adjacent said frame core front surface;

a nonferrous doorframe outer jacket attached to and substantially covers said frames, said ventilation channel, and said electromagnets;

each said electromagnet selectively energized by a D/C power supply electrically connected to said electromagnets; said power supply selectively controlled by a control box;

two air ventilation ports through said outer jacket and said ventilation ports communicating with said ventilation channel and with one said ventilation port located proximate said first end and the other said ventilation port located proximate said second end such that air heated by the electromagnets exits one of said ventilation ports, and traverses the floor surface;

a movable flexible door panel having a door panel jacket and having a door panel periphery and said door panel selectively disposable against said doorframe outer jacket to at least partially block said door opening when in a closed position, said door panel substantially unblocking said door opening when in an open position; said door panel jacket having an upper end and a lower end;

two bottom sweep gasket sections removably attached by attachment means to said door panel jacket proximate said lower end along said door panel periphery that overlap two portions of said doorframe outer jacket when said door panel is in said closed position with one said bottom sweep gasket section located proximate said first end and the other said bottom sweep gasket section located proximate said second end;

a plurality of intermediate gasket sections removably and contiguously attached by attachment means to said door panel jacket between and proximate to said sweep gasket sections and along a contiguous portion of said door panel periphery that overlaps a contiguous portion of said doorframe outer jacket when said door panel is in said closed position and said gasket sections operably configured to form an air seal with said doorframe outer jacket when said door panel is in said closed position; and each said gasket section having at least one ferrous gasket target located proximate said gasket section's surface spaced away from said door panel jacket and towards said doorframe outer jacket and each said ferrous gasket target aligned to cooperate and be magnetically attracted by and to one of said electromagnets when said door panel is in said closed position and said electromagnets are energized.

2. A flexible door panel cold storage door system according to claim 1 further comprising a heat dispersion layer interposed between said frame cores and said electromagnets and said dispersion layer proximately lining said wells and said channel and substantially covering said front surfaces.

3. A flexible door panel cold storage door system according to claim 1 further comprising:

a lower end attachment hook strip attached to, about, and encircling said lower end;

a bottom sweep assembly having a bottom sweep attachment loop strip; said bottom sweep attachment loop strip removably attached to said lower end attachment hook strip and encircling said lower end;

each said bottom sweep gasket section having a transverse bore, said transverse bores aligned and communicating with said ventilation ports when said door panel is in said closed position a depending wall portion of said bottom sweep assembly extending downward beyond said lower end to slidingly engage said floor surface in said door opening between said vertical left frame and said vertical right frame; said lower end, said depending wall portion, and said floor surface defining a bottom sweep assembly air channel, and said depending wall portion having two bottom sweep assembly air ports communicating into and out from said bottom sweep assembly air channel, and said air ports aligned and communicating with said transverse bores; and an inline ventilation fan mounted in said ventilation channel.

4. A flexible door panel cold storage door system according to claim 2 further comprising:

a lower end attachment hook strip attached to, about, and encircling said lower end;

a bottom sweep assembly having a bottom sweep attachment loop strip; said bottom sweep attachment loop strip removably attached to said lower end attachment hook strip and encircling said lower end;

each said bottom sweep gasket section having a transverse bore, said transverse bores aligned and communicating with said ventilation ports when said door panel is in said closed position a depending wall portion of said bottom sweep assembly extending downward beyond said lower end to slidingly engage said floor surface in said door opening between said vertical left frame and said vertical right frame; said depending wall portion and said floor surface defining a bottom sweep assembly air channel, and said depending wall portion having two bottom sweep assembly air ports communicating into and out from said bottom sweep assembly air channel, and said air ports aligned and communicating with said transverse bores; and an inline ventilation fan mounted in said ventilation channel.

5. A flexible door panel cold storage door system according to claim 3 wherein said bottom sweep assembly comprising:

a bottom sweep base strip;

said bottom sweep attachment loop strip attached to and along one side of said base strip;

two bottom sweep air ports in said bottom sweep assembly communicating with said bottom sweep air channel and said air ports aligned and communicating with said transverse bores.

6. A flexible door panel cold storage door system according to claim 4 wherein said bottom sweep assembly comprising:

a bottom sweep base strip;

said bottom sweep attachment loop strip attached to and along one side of said base strip;

two bottom sweep air ports in said bottom sweep assembly communicating with said bottom sweep air channel and said air ports aligned and communicating with said transverse bores.

7. A flexible door panel cold storage door system according to claim 3 wherein said door panel comprising:

a support frame assembly having a header spaced from and connected to at least one door panel base plate segment by at least two spaced vertical suspension cables, each said suspension cable threaded lengthwise through and retained respectively in one of at least two vertical tube stiffeners;

at least one horizontal tube stiffener attached proximately and elastically to and perpendicularly between said two vertical tube stiffeners;

a plurality of flexible insulation sheets facing one another with at least one said insulation sheet on each side of said frame assembly and said insulation sheets supported by said frame assembly; and said door panel jacket encapsulating said support frame assembly and said insulation sheets.

8. A flexible door panel cold storage door system according to claim 4 wherein said door panel comprising:

a support frame assembly having a header spaced from and connected to at least one door panel base plate segment by at least two spaced vertical suspension cables, each said suspension cable threaded lengthwise through and retained respectively in one of at least two vertical tube stiffeners;

at least one horizontal tube stiffener attached proximately and elastically to and perpendicularly between said two vertical tube stiffeners;

a plurality of flexible insulation sheets facing one another with at least one said insulation sheet on each side of said frame assembly and said insulation sheets supported by said frame assembly; and said door panel jacket encapsulating said support frame assembly and said insulation sheets.

9. A flexible door panel cold storage door system according to claim 7 further comprising an overhead horizontal track and carriage system comprising:

at least two door hanger assemblies spaced and aligned coaxially and attached proximate said upper end to said header;

an overhead horizontal track mounted across said top frame;

a carriage assembly movably mounted to said horizontal track;

said door panel suspended from said carriage assembly by said two door hanger assemblies; and said door panel selectively movable between said closed position and said open position.

10. A flexible door panel cold storage door system according to claim 8 further comprising an overhead horizontal track and carriage system comprising:

at least two door hanger assemblies spaced and aligned coaxially and attached proximate said upper end to said header;

an overhead horizontal track mounted across said top frame;

a carriage assembly movably mounted to said horizontal track;

said door panel suspended from said carriage assembly by said two door hanger assemblies; and said door panel selectively movable between said closed position and said open position.

11. A flexible door panel cold storage door system according to claim 9 wherein each said hanger assembly comprising:

a hanger bracket attached to said header;

a horizontal hanger member having a midpoint transverse bore, said hanger member rotatably mounted in said hanger bracket and retained therein by a retainer;

a transverse hanger member rotatably mounted perpendicularly to said horizontal hanger member in said midpoint transverse bore; said transverse hanger member removably attached to said carriage assembly.

12. A flexible door panel cold storage door system according to claim 10 wherein each said hanger assembly comprising:

a hanger bracket attached to said header;

a horizontal hanger member having a midpoint transverse bore, said hanger member rotatably mounted in said hanger bracket and retained therein by a retainer;

a transverse hanger member rotatably mounted perpendicularly to said horizontal hanger member in said midpoint transverse bore; said transverse hanger member removably attached to said carriage assembly.

13. A flexible door panel cold storage door system according to claim 2 wherein said door panel jacket having two panel jacket side surfaces, each said jacket side surface having at least one panel jacket side surface hook pad attached; said door panel jacket having a panel jacket top surface, said panel jacket top surface having at least one panel jacket top surface hook pad attached; each said gasket section having a gasket section hook pad attached along a side length; and further comprising two panel jacket side skirt assemblies each side skirt assembly having a panel jacket side skirt loop pad attached along one side; said panel jacket side skirt assemblies removably attached respectively one to each of said panel jacket side surfaces by at least one said panel jacket side surface hook pad removably engaging one of said side skirt loop pads;

each said side skirt loop pad removably engaging portions of said gasket section hook pads adjacent said side surface hook pad;

a top skirt assembly having a top skirt loop pad attached along one side; said top skirt assembly removably attached to said panel jacket top surface by at least one said panel jacket top surface hook pad removably engaging said top skirt loop pad; and said top skirt loop pad removably engaging portions of said gasket section hook pads adjacent said top surface hook pad.

14. A flexible door panel cold storage door system according to claim 6 wherein said door panel jacket having two panel jacket side surfaces, each said jacket side surface having at least one panel jacket side surface hook pad attached; said door panel jacket having a panel jacket top surface, said panel jacket top surface having at least one panel jacket top surface hook pad attached; each said gasket section having a gasket section hook pad attached along a side length; and further comprising two panel jacket side skirt assemblies each side skirt assembly having a panel jacket side skirt loop pad attached along one side; said panel jacket side skirt assemblies removably attached respectively one to each of said panel jacket side surfaces by at least one said panel jacket side surface hook pad removably engaging one of said side skirt loop pads;

each said side skirt loop pad removably engaging portions of said gasket section hook pads adjacent said side surface hook pad;

a top skirt assembly having a top skirt loop pad attached along one side; said top skirt assembly removably attached to said panel jacket top surface by at least one said panel jacket top surface hook pad removably engaging said top skirt loop pad; and said top skirt loop pad removably engaging portions of said gasket section hook pads adjacent said top surface hook pad.

15. A flexible door panel cold storage door system for selectively blocking and unblocking a door opening in a boundary wall between a cold space and a warm space comprising:

a doorframe assembly, having a vertical left frame, a horizontal top frame, and a vertical right frame, mounted to or in said wall to contiguously define together with a floor surface between said left frame and said right frame of said door opening;

said left frame having a left frame core; said top frame having a top frame core; said right frame having a right frame core; each said frame core having a frame core front surface and a longitudinal front surface centerline;

a plurality of open electromagnet wells in said frame cores distributed along and proximate to said centerlines;

a frame core ventilation channel formed in said frame core front surfaces, said ventilation channel having a first end near said left frame core's bottom end and said ventilation channel contiguously and serially communicating to and through each said well in each said frame core and said ventilation channel having a second end near said right frame core's bottom end;

a heat dispersion layer proximately lining said wells and said ventilation channel and substantially covering said frame core front surfaces;

a plurality of electromagnets operably mounted one electromagnet in each said well and mounted substantially flush to adjacent said frame core front surface;

a nonferrous doorframe outer jacket attached to and substantially covers said frames, said ventilation channel, and said electromagnets;

each said electromagnet selectively energized by a D/C power supply electrically connected to said electromagnets; said power supply selectively controlled by a control box;

two air ventilation ports through said outer jacket and said ventilation ports communicating with said ventilation channel and with one said port located proximate said first end and the other port located proximate said second end;

a movable flexible door panel having a left flexible door leaf and a right flexible door leaf said leaves engageable at an abutting interface between abutting edges of said leaves, each leaf having a leaf jacket and having a leaf jacket periphery and each said leaf selectively disposable against said doorframe outer jacket to at least partially block said door opening when in a respective closed position, each said leaf substantially unblocking said door opening when in a respective open position; each said leaf jacket having an upper end and a lower end;

two bottom sweep gasket sections removably attached by attachment means one to each of said leaf jackets proximate said lower end along said leaf jacket periphery that overlaps a portion of said doorframe outer jacket when said door panel is in said closed position with one said bottom sweep gasket section located proximate said first end and the other said bottom sweep gasket section located proximate said second end;

a plurality of intermediate gasket sections removably and contiguously attached by attachment means to each said leaf jacket proximate and along a contiguous portion of each said leaf jacket periphery that overlaps a contiguous portion of said doorframe outer jacket when said leaves are in said respective closed positions and said gasket sections operably configured to form an air seal with said doorframe outer jacket when said leaves are in said closed position; and each said gasket section having at least one ferrous gasket target located proximate said gasket section's surface spaced away from said leaf jacket and towards said doorframe outer jacket and each said ferrous gasket target aligned to cooperate and be magnetically attracted by one of said electromagnets when said leaves are in said respective closed positions and said electromagnets are energized.

16. A flexible door panel cold storage door system according to claim 15 wherein each said leaf comprising:

a support frame assembly having a header spaced from and connected to at least one door panel base plate segment by at least two spaced vertical suspension cables, each said suspension cable threaded lengthwise through and retained respectively in one of at least two vertical tube stiffeners;

at least one horizontal tube stiffener attached proximately and elastically to and perpendicularly between said two vertical tube stiffeners;

a plurality of flexible insulation sheets facing one another with at least one said insulation sheet on each side of said frame assembly and said insulation sheets supported by said frame assembly; and said leaf jacket encapsulating said support frame assembly and said insulation sheets.

17. A flexible door panel cold storage door system according to claim 16 further comprising at least two door hanger assemblies spaced and coaxially aligned and attached proximate said upper end to said header;

an overhead horizontal track and carriage system comprising:

an overhead horizontal track mounted across said top frame;

two carriage assemblies movably mounted to said horizontal track;

each said leaf suspended respectively by at least two door hanger assemblies from one of said carriage assemblies; and each said leaf movable between said respective closed position and said respective open position.

18. A flexible door panel cold storage door system according to claim 17 wherein each said leaf further comprising:

a lower end attachment hook strip attached to, about, and encircling said lower end;

a bottom sweep assembly having a bottom sweep attachment loop strip; said bottom sweep attachment loop strip removably attached to said lower end attachment hook strip and encircling said lower end;

a depending wall portion of said bottom sweep assembly extending downward beyond said lower end to slidingly engage said floor surface in said door opening; said lower end, said depending wall portion, and said floor surface defining a bottom sweep assembly air channel, and said depending wall portion having a bottom sweep assembly air port communicating into and out from said bottom sweep assembly air channel, and said assembly air port aligned and communicating with one of said ventilation ports when said door panel is in said closed position;

an interface air port in a portion of said bottom sweep assembly in closest proximity to the other said leaf and aligned and communicating with said corresponding interface air port in the other said leaf when said leaves are in said closed position; and an inline ventilation fan mounted in said ventilation channel.

19. A flexible door panel cold storage door system according to claim 18 wherein each said leaf having a magnet strip incorporated into and along said leaf's abutting edge aligned to magnetically attract said corresponding magnet strip in the other said leaf's abutting edge; and each of said leaves having a sealing flap removably attached along a portion of said leaf's abutting edge; and said sealing flaps on opposite faces of said leaves to partially overlap the other said leaf when in said closed position.

20. A flexible door panel cold storage door system according to claim 17 wherein each said leaf jacket having a leaf jacket side surface away from said abutting edges, each said jacket side surface having at least one leaf jacket side surface hook pad attached; said leaf jacket having a leaf jacket top surface, said leaf jacket top surface having at least one leaf jacket top surface hook pad attached; each said gasket section having a gasket section hook pad attached along a side length; and further comprising two leaf jacket side skirt assemblies each side skirt assembly having a leaf jacket side skirt loop pad attached along one side; said leaf jacket side skirt assemblies removably attached respectively one to each of said leaf jacket side surfaces by at least one said leaf jacket side surface hook pad removably engaging one of said side skirt loop pads;

each said side skirt loop pad removably engaging portions of said gasket section hook pads adjacent said side surface hook pad;

a top skirt assembly having a top skirt loop pad attached along one side; said top skirt assembly removably attached to said leaf jacket top surface by at least one said leaf jacket top surface hook pad removably engaging said top skirt loop pad; and said top skirt loop pad removably engaging portions of said gasket section hook pads adjacent said top surface hook pad.

21. A flexible door panel cold storage door system according to claim 9 further comprising two stay roller assemblies mounted to said floor surface, with one roller assembly spaced away from said nonferrous doorframe outer jacket covering said vertical left frame and one roller assembly spaced away from said nonferrous doorframe outer jacket covering said vertical right frame to rollingly engage said door panel above said bottom sweep assembly.

22. A flexible door panel cold storage door system according to claim 10 further comprising two stay roller assemblies mounted to said floor surface, with one roller assembly spaced away from said nonferrous doorframe outer jacket covering said vertical left frame and one roller assembly spaced away from said nonferrous doorframe outer jacket covering said vertical right frame to rollingly engage said door panel above said bottom sweep assembly.

23. A flexible door panel cold storage door system according to claim 17 further comprising two stay roller assemblies mounted to said floor surface, with one roller assembly spaced away from said nonferrous doorframe outer jacket covering said vertical left frame and one roller assembly spaced away from said nonferrous doorframe outer jacket covering said vertical right frame each said roller assembly to rollingly engage one of said leaves above said leaf's bottom sweep assembly.

* * * * *